US006573817B2

(12) United States Patent
Gottschalk

(10) Patent No.: US 6,573,817 B2
(45) Date of Patent: Jun. 3, 2003

(54) VARIABLE-STRENGTH MULTIPOLE BEAMLINE MAGNET

(75) Inventor: Stephen C. Gottschalk, Woodinville, WA (US)

(73) Assignee: STI Optronics, Inc., Bellevue, WA (US)

( * ) Notice: Subject to any disclaimer, the term of this patent is extended or adjusted under 35 U.S.C. 154(b) by 0 days.

(21) Appl. No.: 09/823,614

(22) Filed: Mar. 30, 2001

(65) Prior Publication Data

US 2002/0158736 A1 Oct. 31, 2002

(51) Int. Cl.[7] ..... H01F 7/02
(52) U.S. Cl. ..... 335/306; 335/302
(58) Field of Search ..... 335/296.9, 302.6; 315/5.34–5.35; 313/433, 442

(56) References Cited

U.S. PATENT DOCUMENTS

| | | | | |
|---|---|---|---|---|
| 2,305,761 A | | 12/1942 | Borries et al. | |
| 2,883,569 A | | 4/1959 | Kaiser et al. | |
| 2,895,092 A | | 7/1959 | Cluwen | |
| 3,283,200 A | * | 11/1966 | Pallakoff | 335/306 |
| 3,387,241 A | | 6/1968 | Audoin et al. | |
| 3,768,054 A | | 10/1973 | Neugebauer | |
| 3,781,736 A | | 12/1973 | Parker | |
| 3,831,121 A | | 8/1974 | Oster | |
| 4,153,889 A | | 5/1979 | Ikegami | |
| 4,355,236 A | | 10/1982 | Holsinger | |
| 4,381,490 A | | 4/1983 | Peters | |
| 4,429,229 A | | 1/1984 | Gluckstern | |
| 4,538,130 A | | 8/1985 | Gluckstern et al. | |
| 4,549,155 A | | 10/1985 | Halbach | |
| 4,633,208 A | * | 12/1986 | Voss et al. | 335/210 |
| 4,714,908 A | | 12/1987 | Watabe et al. | |
| 4,857,841 A | * | 8/1989 | Hastings et al. | 324/208 |
| 4,937,545 A | * | 6/1990 | Chaillout et al. | 335/298 |
| 5,003,276 A | * | 3/1991 | Sarwinski et al. | 335/304 |
| 5,010,640 A | | 4/1991 | Gottschalk | |
| 5,021,670 A | | 6/1991 | Lanio et al. | |
| 5,237,301 A | * | 8/1993 | Unkelbach et al. | 335/306 |
| 5,420,556 A | | 5/1995 | Okazaki | |

OTHER PUBLICATIONS

*NLC The Next Linear Collider Project*, NLC Permanent Magnets Collaboration Meeting, Jan. 31–Feb. 2, 2000; A. Ringwall, C. Spencer (SLAC), J. Volk, B. Fowler (Fermi), S. Marks, R. Schlueter, and K. Robinson (LBL).

* cited by examiner

*Primary Examiner*—Lincoln Donovan
(74) *Attorney, Agent, or Firm*—Christensen O'Connor; Johnson Kindness PLLC

(57) ABSTRACT

A multipole beamline magnet (10) includes a plurality of stationary poles (12) formed of ferromagnetic material and one or more permanent magnets (14) that are disposed between the plurality of stationary poles. Each of the permanent magnets supplies magnetomotive force to two adjacent stationary poles, so that the poles produce a magnetic field in a central space (16) defined by the poles. A mechanical axis (18) of the beamline magnet is defined to extend through the central space, perpendicularly to the plane defined by the poles and the magnets. The beamline magnet further includes a linear drive (20) that is adapted to move the permanent magnet(s) perpendicularly to the mechanical axis. Thus constructed, the beamline magnet produces a high-quality field using its stationary poles, and further allows for selective adjustment of the magnetic field strength and the magnetic centerline by collectively or selectively moving the permanent magnets.

55 Claims, 12 Drawing Sheets

VARIABLE-STRENGTH MULTIPOLE BEAMLINE MAGNET

FIELD OF THE INVENTION

The present invention relates to variable-strength multipole beamline magnets, and more specifically, to a beamline magnet that permits the adjustment of not only the field strength but also the magnetic centerline.

BACKGROUND OF THE INVENTION

A number of techniques are available for producing variable-strength magnets. They are especially useful for bending, focusing, and higher-order control of beams in charged particle accelerators. Most charged particle beam accelerators use magnets to control the beam. This is especially true for high-energy accelerators, i.e., relativistic particle accelerators. The magnets affect the beam in ways that are mathematically similar, but not identical, to how optical lenses and mirrors affect an optical beam. In the present description, devices based on pseudo-optical properties of magnets are called beamline magnets.

Common beamline magnets are dipoles, quadrupoles, and sextupoles. Dipoles change the direction of the beam as well as provide some focusing or defocusing, like a light pipe with lenses. Quadrupoles focus the beam like a lens. Sextupoles can be used to correct certain types of aberrations. More generally, a beamline magnet with a plurality of poles, including dipoles, quadrupoles, and sextupoles, is termed a multipole magnet. For example, an octupole that uses eight poles is also a multipole magnet, which is suitable for correcting higher-order distortions of the beam.

Many beamline magnets are electromagnets. In these devices ordinary or superconducting coils are wound around specially shaped poles to generate the desired magnetic field. Adjusting the current passing through the coil(s) controls the magnetic field strength. This has the desirable property that the pole shape controls the field quality. The coils simply supply the magnetomotive force needed to generate the field. Room temperature coils usually need cooling to dissipate the heat generated by the finite resistance of the coils. This is accomplished by using fans, cooling channels, or liquid-cooled copper tubing for forming the coils. When copper tubing is used to form the coils, deionized water is circulated within the tubing while the current flows through the copper. There are a number of limitations to electromagnets. One is that expensive electrical power and additional plumbing are needed to operate these magnets. In addition, an electromagnet has a size limitation because the current densities, with which the power dissipation scales quadratically, are inversely proportional to the magnets' linear dimension. Thus, smaller electromagnets need to use reduced currents to avoid cooling problems, and cannot have strong fields.

A second, less common type of beamline magnet is made by arrangements of specially shaped magnets. These devices use special arrangements of magnets without poles to produce the desired fields. Sample magnets of this type can be found in U.S. Pat. No. 4,355,236 to Holsinger and U.S. Pat. Nos. 4,429,229 and 4,538,130 to Gluckstern. In these devices, the magnetic field strength is adjusted by rotating rings or disks of magnets. Because of the absence of poles, the magnetic fields of the individual magnets superimpose on each other, which makes analysis of their performance much easier. These magnets also have the advantage that they do not require power supplies to generate currents in the coils or plumbing for cooling the coils as in the electromagnets. However, the field quality produced by these magnets is inferior to that produced by electromagnets. Any mechanical imperfection of the magnets or magnetization nonuniformity degrades the magnetic field quality.

A third type of beamline magnet uses poles to produce a high-quality field like the one produced by an electromagnet, but uses permanent magnets in place of the coils used in an electromagnet. A sample device of this type can be found in U.S. Pat. No. 4,549,155 to Halbach, wherein the field strength is adjusted by rotating magnets. The rotation of magnets, however, causes the field strength to vary nonlinearly and sinusoidally as a function of a rotating angle, which makes it difficult to adjust the field strength with high precision. Another example of the type of beamline magnet using poles and permanent magnets can be found in U.S. Pat. No. 2,883,569 to Kaiser et al. In this patent, a flux shunt selectively slides over a portion of a cylindrical magnet to short out a varying amount of the magnetic field. This design, though, is intrinsically less efficient because there is a major magnetic flux leakage path between pairs of poles. In addition, this design also produces a nonlinear field adjustment, which is not desirable for high-precision strength adjustment. Yet another example of this type of beamline magnet uses cylindrical magnets that are individually rotated about their axes of symmetry. For these designs, there is one rotating magnet for each pole. The field strength is varied by adjusting the angular position of each magnet with respect to each pole. As before, this style of magnet produces a sinusoidal variation in the magnetic field strength and it is difficult to remove backlash in the rotational system to achieve precise adjustment of the field strength. In addition, many applications require a field strength setting ($\Delta B/B$) of $1/10000$ (0.01%). This implies extremely fine angular resolution: the angular encoders need to have resolutions of $1/50000$ radians, or approximately 300,000 encoder ticks in 360 degrees, which would be extremely difficult to obtain, if not impossible.

A need exists for a beamline magnet which does not require power supplies or plumbing, and yet produces a high-quality field. Preferably, such a beamline magnet is capable of achieving nonsinusoidal field strength adjustment to allow for high precision adjustment.

SUMMARY OF THE INVENTION

The present invention provides a multipole beamline magnet that is capable of selectively adjusting magnetic field strength and a magnetic centerline. Specifically, the beamline magnet includes a plurality of stationary poles formed of ferromagnetic material and one or more permanent magnets that are disposed between the plurality of stationary poles. Each of the permanent magnets supplies magnetomotive force to two adjacent stationary poles, so that the poles produce a magnetic field in a central space defined by the poles. A mechanical axis of the beamline magnet extends through the central space perpendicularly to the plane defined by the magnets and the poles. The beamline magnet further includes a linear drive for moving the permanent magnet(s) along radial lines perpendicularly to the mechanical axis, i.e., radially inward or outward with respect to the mechanical axis. Thus constructed, the beamline magnet produces a high-quality field using its stationary poles, and further allows for precise adjustment of the magnetic field strength and the magnetic centerline by collectively or selectively moving the permanent magnets.

In accordance with one aspect of the invention, the beamline magnet further includes a pair of nonmagnetic end caps that are provided to sandwich the poles and the magnets. In one embodiment, at least one of the end caps defines one or more guide channels for movably mounting the one or more permanent magnets, respectively. The guide channels are provided for greater control of the linear movement of the magnets.

In accordance with another aspect of the invention, the beamline magnet further includes a pair of ferromagnetic shield plates mounted on the nonmagnetic end caps, to thereby sandwich the nonmagnetic end caps, which in turn sandwich the poles and the magnets. The shield plates are used to effectively eliminate magnetic interactions between the beamline magnet and nearby instruments or other beamline magnets.

In accordance with yet another aspect of the invention, the beamline magnet further includes a magnetic field sensor arranged to determine the strength of the magnetic field in the central space defined by the stationary poles. The sensed magnetic field strength data may then be used to control the linear drive for selectively or collectively moving the permanent magnets.

In accordance with still another aspect of the invention, the beamline magnet further includes a beam position sensor arranged to sense the location of a charged particle beam in the central space defined by the stationary poles. The sensed beam position may then be used to control the linear drive for selectively or collectively moving the permanent magnets to adjust the magnetic field strength or magnetic centerline.

In accordance with still another aspect of the invention, the beamline magnet includes a means of passive temperature compensation for maintaining the magnetic field strength substantially constant regardless of any changes in the operating temperature. Specifically, ferromagnetic materials having a low Curie temperature are magnetically coupled to the permanent magnets in a parallel flux shunting configuration to compensate for temperature-dependent flux variation of the permanent magnets. At a low temperature, the permanent magnets are stronger than at a high temperature, and thus could supply more flux in the central space than at a high temperature. At a low temperature, though, the ferromagnetic materials shunt a larger fraction of the available flux away from the central space than they do at a high temperature. Consequently, the resulting flux in the central space is substantially the same at both low and high temperatures; at a low temperature, the magnets are stronger but more flux is shunted away from the central space, and at a high temperature, the magnets are weaker but less flux is shunted away from the central space. With proper choice of the ferromagnetic material, its dimensions and location, the magnetic field strength can be maintained at an essentially constant level despite changes in the operating temperature.

In accordance with still another aspect of the invention, the beamline magnet includes a means of passive temperature compensation to correct for thermally induced shifts of the magnetic centerline. Centerline shifts can be caused by various thermal reasons, for example, by thermal expansion or contraction of all the materials in the beamline magnet, temperature dependence of the magnetic properties of the permanent magnets, and temperature induced movement of a support platform on which the beamline magnet is mounted. According to the present invention, thermal compensation of centerline shift is achieved by coupling different amounts of temperature compensating material (i.e., ferromagnetic material having a low Curie temperature) on each magnet. With proper choice of the material, its dimensions and location, the magnetic centerline can be maintained at an essentially constant location despite changes in the operating temperature.

In accordance with still another aspect of the invention, the beamline magnet further includes electromagnetic corrector coils to make small adjustments to the magnetic centerline and/or the magnetic field strength. One or more corrector coils are strategically placed to selectively supply a predetermined amount and polarity of magnetomotive force to one or more stationary poles. Adjustment using the electromagnetic corrector coils is achieved by merely modifying wiring of, and the current passing through, the coils, and hence the adjustment is quick and precise. For fine-tuning the field strength and/or the magnetic centerline, electromagnetic adjustment may be more advantageous than the mechanical adjustment of the present invention using the linear movement of the permanent magnets.

In accordance with still another aspect of the invention, the beamline magnet includes a plurality of poles and a plurality of permanent magnets. The poles and the magnets may be provided in equal numbers, and may be arranged equiangularly over 360°. The poles may be made of various materials and in various shapes. All the poles in a beamline magnet may be fabricated the same, or differently from each other. Likewise, the permanent magnets may be made of various materials, in various shapes, and having various magnetization directions. All the permanent magnets in the beamline magnet may be fabricated the same or differently from each other. Furthermore, each of the permanent magnets may be formed of a plurality of submagnet portions having the same or different shapes or properties. The shapes and properties of each pole and each permanent magnet (or submagnet portion) are determined so as to produce the desired magnetic field distribution according to each application.

In accordance with still another aspect, the beamline magnet of the present invention further includes one or more stationary auxiliary magnets positioned between the central space defined by the poles and the one or more permanent magnets, respectively. In other words, the auxiliary magnets are arranged radially inward of the permanent magnets with respect to the mechanical axis. The auxiliary magnets remain fixed while the permanent magnets disposed radially outward of the auxiliary magnets are moved.

In accordance with a further aspect, the beamline magnet of the present invention includes a ferromagnetic tuning shim. For example, the shim may be attached to the stationary auxiliary magnets, moving permanent magnets, poles, end magnets, or the nonmagnetic end caps. Shims serve to compensate for field errors produced due to imperfection in fabricating the permanent magnets and/or the poles.

The present invention further provides a method of selectively adjusting a magnetic field in a multipole beamline magnet. The method includes three steps. First, a plurality of stationary ferromagnetic poles are provided. Second, a plurality of permanent magnets are arranged between the plurality of stationary ferromagnetic poles, so that each of the permanent magnets supplies magnetomotive force to two adjacent stationary ferromagnetic poles. As a result, the stationary ferromagnetic poles produce a magnetic field in a central space defined by the stationary ferromagnetic poles. A mechanical axis of the beamline magnet is defined to extend through the central space, perpendicularly to the plane defined by the magnets and the poles. Finally, the one or more permanent magnets are moved perpendicularly to the mechanical axis.

The method may be applied in various ways to achieve the desired adjustment to the magnetic field, such as adjusting the field strength and the magnetic centerline. In a general case, the magnets are individually moved to selectively adjust the magnetic field strength and the magnetic centerline.

In a more special case, one may apply the method to adjust the strength of the magnetic field without changing the field distribution. This may be done, for example, by collectively moving all the permanent magnets in a radially inward or outward direction relative to the mechanical axis so as to uniformly increase or decrease the magnetic flux coupling to all the poles. The strength adjustment may be linear, thus allowing for high precision adjustment.

As another special case, one may adjust the magnetic centerline without changing the field strength. This may be done, for example, by moving a pair of opposing permanent magnets that are 180° apart in one direction. Such movement merely translates (i.e., shifts in parallel) magnetic flux lines, and in effect linearly moves the magnetic centerline.

The present invention offers various advantages. First, the beamline magnet of the present invention does not require power supplies or plumbing, and yet produces a high-quality field due to the use of stationary poles. Second, the invention allows for linear adjustment of the field strength and the magnetic centerline, which in turn permits high precision adjustment of the field strength and the centerline. Third, in the present invention the magnets are moved linearly to make various adjustments, as opposed to being rotated, thus the precise adjustment of the magnets is made easier. This permits extremely accurate adjustments of the field strength (0.01%) and the magnetic centerline (microns) with commercially available linear encoders having 1–20 micron resolution. As discussed above, designs that use rotary motion typically require angular resolutions of approximately 300,000 encoder ticks in 360 degrees for 0.01% accuracy. This is not easily achieved with any commercial encoders.

Fourth, the present invention is versatile in permitting various adjustments of the magnetic field. For example, the present invention may be used to adjust the field strength without changing the magnetic centerline, or adjust (shift) the magnetic centerline without changing the field strength. Fifth, the versatile field adjustment capability described above may be readily applied to compensate for any errors in the magnetic properties of the beamline magnet (i.e., magnetic field strength, magnetic centerline, and magnetic field distribution) introduced during fabrication of the beamline magnet. For example, if the permanent magnets have differing strengths, then they can be moved linearly to compensate for the differences. If the magnetization direction of the permanent magnets is nonuniform, then the tuning shims can be used to compensate. Likewise, imperfections in the pole shapes or poles' magnetization properties can be compensated for by combinations of linear motion of the permanent magnets and the use of ferromagnetic tuning shims. Furthermore, when electromagnetic corrector coils are provided, fine adjustments of the field strength or the magnetic centerline can be readily achieved by selectively wiring and passing a current thorough the coils. Thus, the present invention is highly tolerant to variations in the quality of the magnets and/or poles, thereby reducing the overall cost of manufacturing.

Lastly, the construction of the beamline magnet is such that it allows one to access the central space of the beamline magnet by removing one or more permanent magnets. This advantageously permits the beamline magnet to receive an electron beam sensor adjacent the central space for monitoring the behavior of the electron beam passing through the beamline magnet.

BRIEF DESCRIPTION OF THE DRAWINGS

The foregoing aspects and many of the attendant advantages of this invention will become more readily appreciated by reference to the following detailed description, when taken in conjunction with the accompanying drawings, wherein.

DETAILED DESCRIPTION OF THE PREFERRED EMBODIMENT

Figure 1:
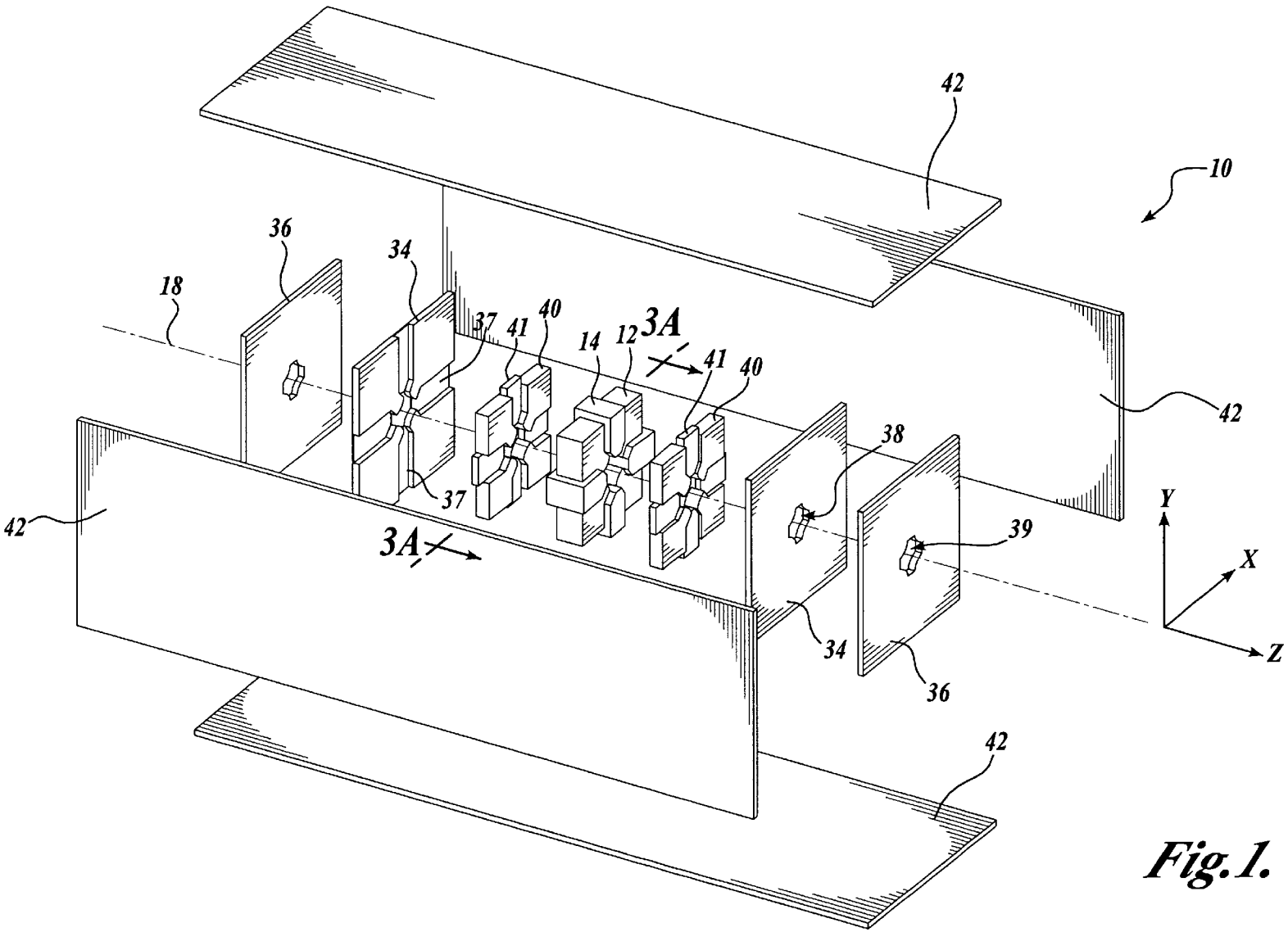
FIG. 1 is an exploded view of a quadrupole beamline magnet comprising four stationary poles and four movable magnets, formed in accordance with the present invention.
Figure 2A:
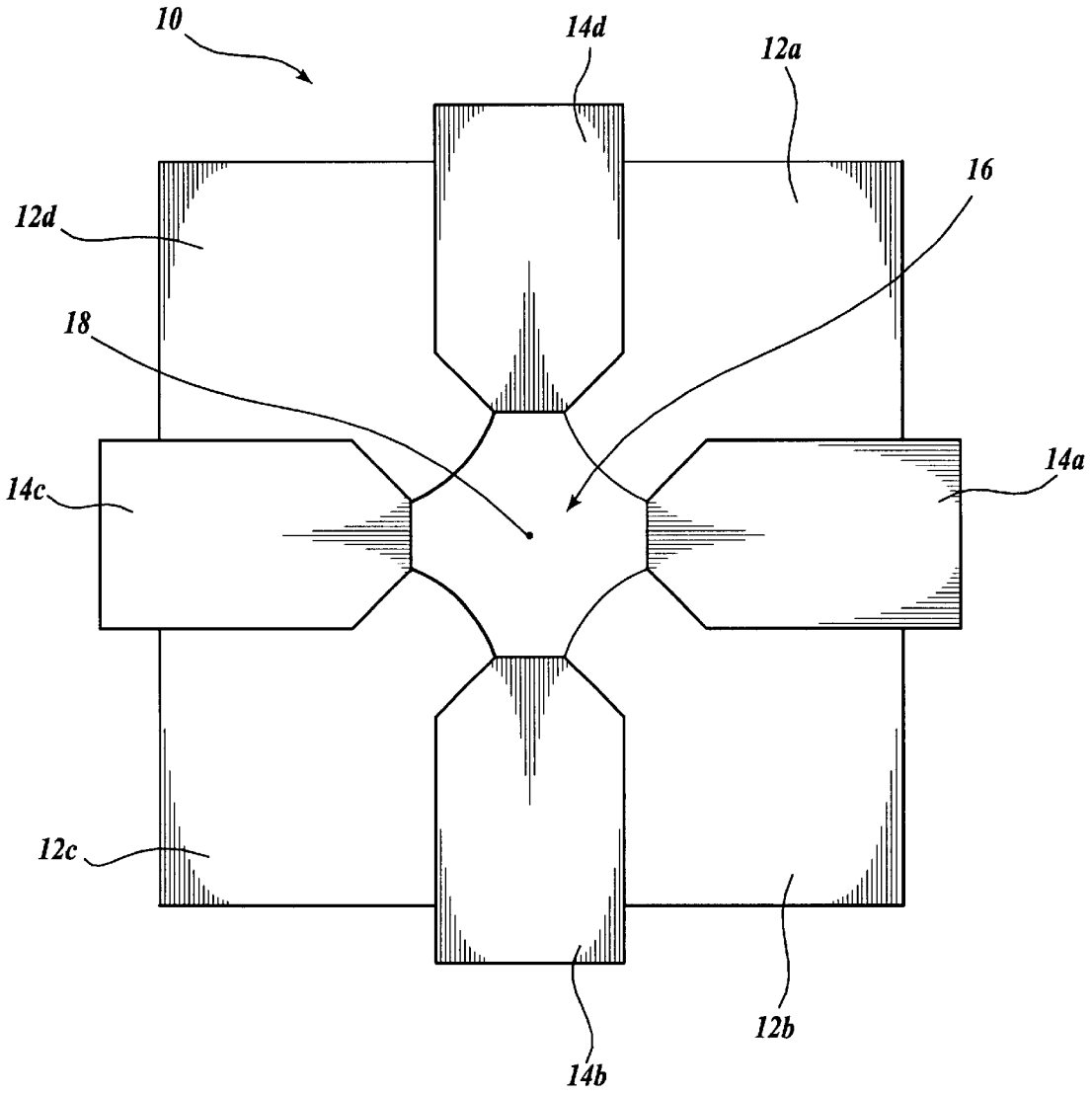
FIG. 2A is a partial plan view of the quadrupole beamline magnet of FIG. 1, illustrating the four poles and four magnets.
Figure 2B:
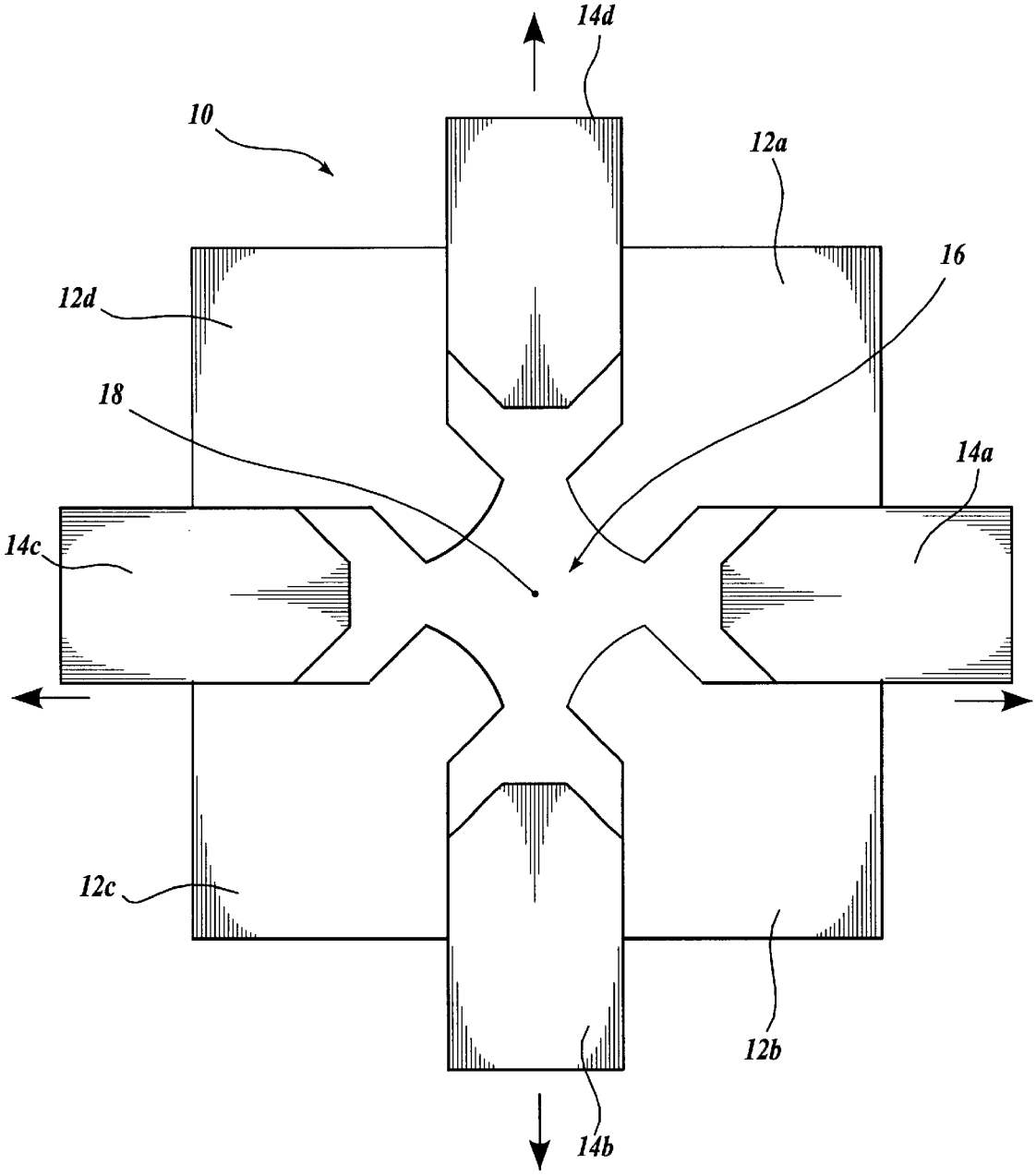
FIG. 2B illustrates the four poles and four magnets of FIG. 2A, wherein the four magnets are collectively retracted radially to linearly decrease the magnetic field strength.

Referring to FIG. 1, a multipole beamline magnet 10 is provided that is capable of selectively adjusting magnetic field strength and a magnetic centerline. Referring additionally to FIG. 2A, the beamline magnet 10 includes a plurality of stationary ferromagnetic poles 12*a*–12*d* and one or more permanent magnets 14*a*–14*d* disposed between the plurality of stationary ferromagnetic poles 12*a*–12*d*. In the present description, the term ferromagnetic is used interchangeably with the terms "magnetically soft" and "magnetically permeable", to refer to reasonably high permeability of at least 10 $\mu_0$ ($\mu_0$=permeability of free space). Each of the permanent magnets 14 supplies magnetomotive force to two adjacent stationary ferromagnetic poles 12, so that the poles 12 produce a magnetic field in a central space 16 defined by the poles 12. A mechanical axis 18 of the beamline magnet 10 extends, perhaps centrally, through the central space 16 perpendicularly to the plane defined by the poles 12 and the magnets 14 (i.e., the x-y plane in FIG. 1). The beamline magnet 10 further includes a linear drive 20 (see FIG. 3A) that is configured to move the permanent magnets 14 perpendicularly to the mechanical axis 18, i.e., radially inward or outward with respect to the mechanical axis 18. For example, FIG. 2B illustrates that all four magnets 14 are collectively moved radially outward, or radially retracted, with respect to the mechanical axis 18, as indicated by arrows.

Thus constructed, the beamline magnet 10 produces a high quality field using its stationary poles 12, and further allows for selective adjustment of the magnetic field strength and the magnetic centerline by collectively or selectively moving the magnets 14 linearly.

The mathematical analysis of a beamline magnet of the present invention is now described. From Maxwell's equations, it can be shown that the magnetic field components in the x and y directions, $B_x$ and $B_y$, generated by a multipole beamline magnet may be written in the following form:

$$\int_{-\infty}^{+\infty}(B_x(x, y, z) + iB_y(x, y, z))dz = \sum_{n=0}(a_n + ib_n)r^n e^{in\phi} \quad (1)$$

where the magnetic center of the beamline magnet on the z=0 plane is defined at (x, y, z)=(0, 0, 0); n is the order of fields, specifically, uniform fields (n=0) are called dipoles, linear fields (n=1) are called quadrupoles, and quadratic fields (n=2) are called sextupoles; $r=\sqrt{x^2+y^2}$;

$$\tan\phi = \frac{y}{x};$$

and $a_n$ and $b_n$ are multipolar coefficients representing the multipolar strengths of the beamline magnet, determined by various factors such as the shape of poles and the strength and magnetization direction of the magnets. Practical dipoles, quadrupoles, and sextupoles try to achieve fields that have only one nonzero $a_n$ or $b_n$. Typically, the magnetic centerline is the path along which the charged particle beam is intended to travel. In one type of dipole called a sector magnet, the magnetic centerline is actually an arc and the x, y axes rotate with the arc. Thus, the magnetic centerline is the (x, y)=(0, 0) line (or arc). The expansion of equation (1) is called a harmonic function. It is only mathematically valid over a circle of radius r that does not pass through ferromagnetic material or a magnet. Even if a particular application is not amenable to the use of equation (1), it is always possible to define a unique line in the central space 16 of the beamline magnet 10 that can be designated as the magnetic centerline, as will be apparent to those skilled in the art.

The construction of the multipole beamline magnet 10 in accordance with the present invention is now described in detail. While the following describes a quadrupole beamline magnet including four stationary poles 12, it should be readily understood by those skilled in the art that the present invention can be equally applied to form other multipole beamline magnets such as dipole, sextupole, and octupole magnets.

Figure 3A:
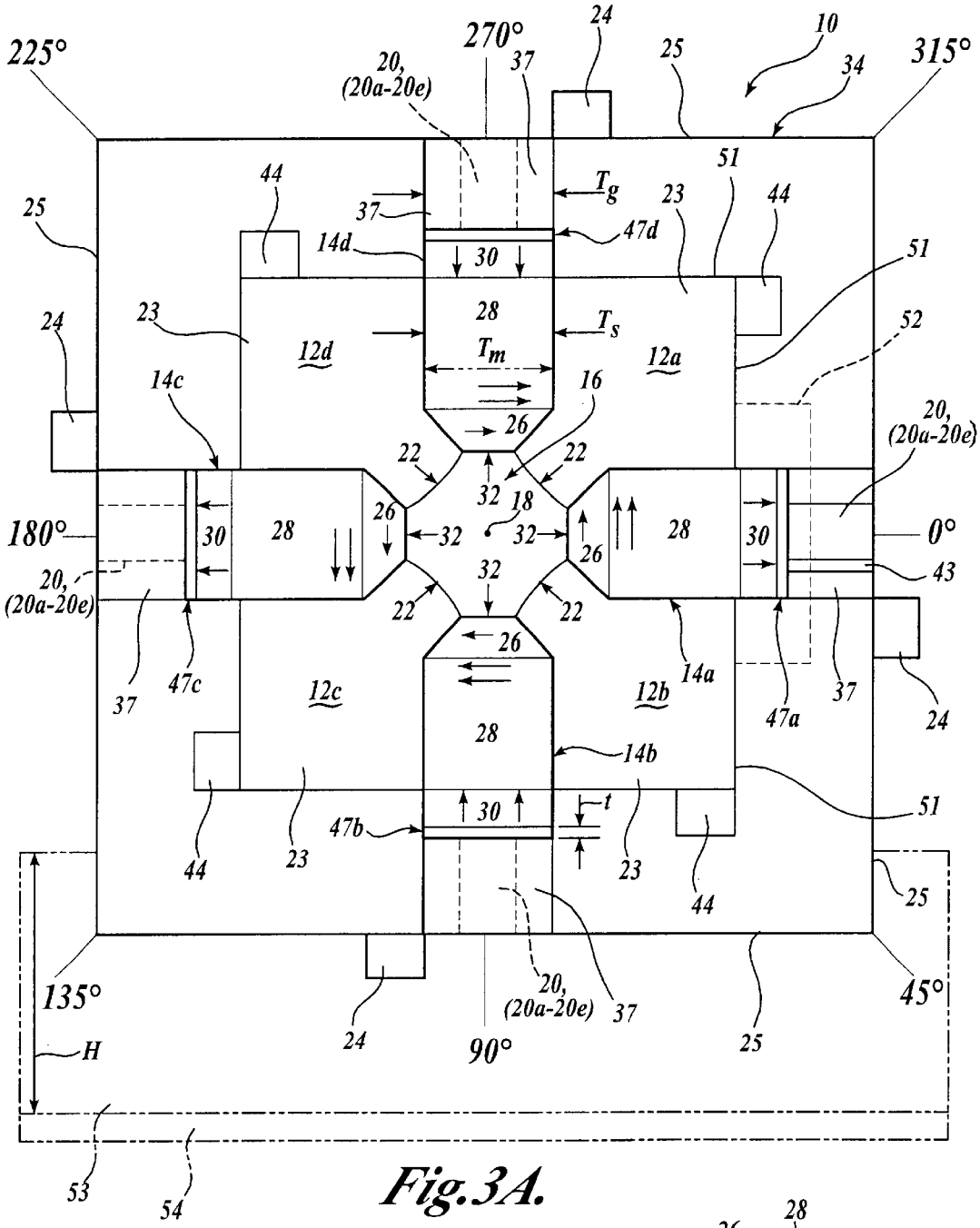
FIG. 3A is a schematic cross-sectional view of the quadrupole beamline magnet of FIG. 1 taken along the x-y plane, illustrating the four poles and four magnets mounted on an end cap.

Referring additionally to FIG. 3A, the stationary ferromagnetic poles 12*a*–12*d* are formed of any magnetically soft or magnetically permeable materials, which are usually chosen to minimize saturation effects. Examples of pole materials are low-carbon steels, commonly called electrical steels, and vanadium permendur. In most applications the different poles 12*a*–12*d* will be made of the same material, but in some applications they may be made of different materials. Furthermore, in some applications, it may be cost effective to use more than one type of steel in forming each of the poles 12, for example, expensive vanadium permendur in high-field regions and low-cost electrical steels elsewhere.

A general advantage of using the poles 12 is that the quality of a magnetic field produced by the poles 12 is primarily determined by how well the pole faces 22 are machined. The shape of the pole faces 22 generally determines the magnetic field distribution (or field profile) in the central space 16 defined by the poles 12. This is so because the poles 12 function to homogenize local nonuniformity in magnetization of the magnets 14. In other words, the use of the poles 12 serves to compensate for nonuniformity in magnetization of the magnets 14. In fact, beamline magnet designs using poles are about ten times less sensitive to permanent magnet imperfections than those designs that do not use poles.

In most applications the pole faces 22 are not saturated. This means that the surface 22 of each pole 12 is designed to be at a particular magnetic potential value. According to the present invention, the magnetic potential values of the poles 12 may be readily adjusted by selectively moving the magnets 14 to vary the flux coupling of their adjacent poles 12, as more fully described later. Changes in the potential values in turn produce magnetic field variation. In other words, changes in the magnetic potential values are used to adjust the magnetic field strength or magnetic centerline.

To produce a high-quality magnetic field, the pole faces 22 preferably define magnetic equipotential surfaces, for example hyperbolic surfaces in the case of a quadrupole magnet 10 as illustrated in FIG. 3A. In the illustrated embodiment, portions 23 of the poles 12 radially away from the mechanical axis 18 are generally square so that the outline 25 of the beamline magnet 10 is defined by flat surfaces to permit easy fiducialization. Specifically, when the back portions 23 of the poles 12 are generally square, an end cap 34 (see also FIG. 1) on which the poles 12 and magnets 14 are mounted (to be more fully described below) also takes a correspondingly square shape having the outline 25 comprising four flat sides. Four reference points 24 are marked along the four sides, respectively, which will be used for fiducializing (i.e., locating) the beamline magnet 10 in space. In actual practice, the reference points 24 will be placed in any locations that are determined by the need to accurately survey the location of the beamline magnet 10. However, since the portions 23 of the poles 12 radially away from the central space 16 do not carry much magnetic field, their shapes are less important than the shape of the pole faces 22. As will be understood by those skilled in the art, the shape of the poles 12 may be freely varied to produce the desired field distribution in each application. For example, the desired shape of each pole may be determined based on a variety of analytical or experimental models, such as potential theory, conformal mapping, and finite element analysis (FEA). In some applications, it may be desirable to have all the poles 12 in the same shape, while in other applications it may be advantageous to form each of the poles 12 in a different shape to produce the desired field distribution. An example of an application in which different pole shapes would be needed is a sextupole magnet that surrounds a vacuum chamber having a rectangular outer surface. This type of vacuum chamber is used in some particle accelerators. An efficient multipole magnet design for this application would use two different pole shapes, as will be appreciated by those skilled in the art.

The permanent magnets 14 are provided to supply magnetomotive force to adjacent poles 12. The magnets 14 may be formed of any permanent magnet material. In a preferred embodiment, the magnets 14 have a linear B-H curve for positive inductions B and negative magnetizing fields H. The region of the magnet 14 which is closest to the central space 16 contributes substantially to the field strength but this region of the magnet is also operated at the most negative values of H. In a preferred embodiment, anisotropic rare earth permanent magnet materials (REPM), such as neodymium iron boron (NdFeB) and rare earth cobalt (REC) would be used. Isotropic magnets are less desirable because their strengths are lower and they are less resistant to demagnetization. Nonlinear magnetic materials, such as Alnico and ferrites, would become partially demagnetized if the magnets 14 made of such materials were fully inserted.

As with the poles 12, the magnets 14 may all have the same shape, or may have different shapes, as long as they are shaped to allow for unobstructed linear motion, perpendicularly to the mechanical axis 18. Likewise, the magnets 14 may all have the same magnetization direction or different magnetization directions depending on each application. Those skilled in the art will understand that the desired shape and magnetization direction of each magnet may be determined using a variety of analytical models or experimentation techniques. In FIG. 3A, all four magnets 14*a*–14*d* are illustrated to be formed in the same shape. The magnets 14*a*–14*d* have the same magnetization direction with respect to their longitudinal side faces, and are rotated in space so that their magnetization directions are oriented as indicated by arrows.

Each of the magnets 14 may be formed of a plurality of submagnets of various properties (materials, shapes, and magnetization directions). For example, still referring to FIG. 3A, each magnet 14 may comprise three submagnet portions: a first portion 26 in a trapezoidal shape, a second portion 28 in a rectangular shape, and a third portion 30 also in a rectangular shape. Each of these three submagnet portions 26, 28, 30 may be formed of the same or different materials, may be formed in the same shape or different shapes, may have the same or different magnetization directions, and are combined together using a suitable adhesive material.

The shapes of the magnets 14*a*–14*d* or the submagnet portions 26, 28, and 30 are preferably chosen to make fabrication easier. Each of the magnets 14 may be formed in, for example, a rectangular shape, a rectangular shape with at least one of its four corners chamfered, a wedge shape, or in a combination of a rectangular shape and a trapezoidal shape as illustrated in FIG. 3A. The submagnet portions 26, 28, and 30 may also be formed of a variety of shapes. A trapezoidal shape makes slightly more efficient use of magnetic material than a rectangular shape, but is slightly more difficult to fabricate and test its magnetic and geometrical properties.

In one preferred embodiment as illustrated in FIG. 3A, the first trapezoidal portions 26 and the second rectangular portions 28 have the same magnetization direction as shown in arrows, which is oriented perpendicular to the longitudinal axis of the magnets 14*a*–14*d*. In such a case, the first and second submagnet portions 26 and 28 may be integrally formed in a single piece rather than formed of separate pieces being joined together. The third rectangular portions 30 may have the same magnetization direction as the second square portions 28, or may have a different magnetization direction, as indicated by arrows in FIG. 3A, so as to increase the field strength. Specifically, it is often advantageous to arrange submagnets that are most radially apart from the mechanical axis 18, such as the third rectangular portions 30 in FIG. 3A, to have a different magnetization direction from that of the rest of the magnets to reduce undesirable leakage of fields. The radially outermost submagnets used in this manner are called "corrector magnets". Thus, in this case, the outermost magnets 30 are used as corrector magnets.

In some applications, it may be preferable to use different magnetic materials to form various submagnet portions 26, 28, 30. In the illustrated design of FIG. 3A, the first trapezoidal portions 26, which are radially closest to the central space 16 defined by the poles 12, are subjected to large demagnetization fields and may also be subjected to high levels of radiation when certain charged particles are passing through the central space 16 along the mechanical axis 18. Thus, the first portions 26 of submagnets preferably have very high coercivity and/or are highly radiation resistant. Those skilled in the art will understand that ultrahigh coercivity grades of neodymium iron boron magnets are substantially immune to demagnetization fields present in the beamline magnet 10 of FIG. 3A. In addition, these grades of neodymium iron boron are the most radiation resistant of all the neodymium iron grades. Though they have a reduced remanence, this will be acceptable.

Another material that may be used to form the first portions 26 of submagnets is samarium cobalt, which has a high remanence and is resistant to both demagnetization and radiation. However, cobalt in this material becomes activated by radiation, which can make servicing of the beamline magnet 10 impossible until the radiation falls to safe levels. A third material that may be used is ferrite. Ferrite is as radiation resistant as samarium cobalt, but is easily demagnetized and thus may be undesirable in that regard. A final choice is to apply lead shielding over the faces of the first portions 26 of submagnets. In most charged particle accelerators, beamline magnet(s) 10 surround a circular vacuum tube. When this occurs, a lead shield could be inserted coaxially between the vacuum tube and the permanent magnets 14. Lead shielding is mainly advantageous for low charged particle beam energies (100's of Mev for electrons). Lead shielding is much less effective for the very high energies parts of an accelerator (1000's of Mev for electrons).

The second portions 28 of submagnets may be formed of materials having higher remanence but lower demagnetization stability than the first portions 26 of submagnets. Further, the third portions 30 of submagnets may be formed of material having higher remanence but lower demagnetization stability than the first and second portions 26, 28 of submagnets. In particular, the third portions 30 of submagnets that are subject to less radiation and demagnetization effects may be advantageously formed of inexpensive, low-remanence, radiation-resistant ferrites. It will be appreciated by those skilled in the art that there are a variety of analyses and experimentation techniques available that permit determination of the optimum material choices for a particular intended application.

Figure 3B:
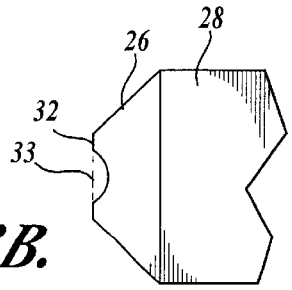
FIG. 3B is a partial enlarged view of the beamline magnet of FIG. 3A, illustrating a recessed magnet face.

Referring to FIG. 3B, faces 32 of the first portions 26 of submagnets interfacing the central space 16 may be recessed or include a setback. The purposes of the recessed or setback faces 32 are to reduce the demagnetization fields in the first portions 26 and/or to permit the attachment of a magnetically soft tuning shim 33 to the magnet faces 32. The shim 33 is used to correct various types of field errors, such as field strength errors, magnetic centerline errors, or field distribution errors (distortions). These errors occur due to imperfection in the fabrication process of the magnets 14 and/or the pole pieces 12, and are usually called multipole errors. A method of error compensation using shims 33 will be more fully described later.

When a plurality of submagnets are used, it may be advantageous to fix one or more of the submagnets that are radially closest to the mechanical axis 18 as stationary auxiliary magnets. In FIG. 3A, for example, the first portions 26 of the submagnets may be fixed to form stationary auxiliary magnets, while the second and third portions 28 and 30 of the submagnets are combined together to form the movable magnets 14, which can move radially outwardly or inwardly with respect to the mechanical axis 18. This arrangement may be advantageous when, for example, the first portions 26 of submagnets are made from a fragile material such as samarium cobalt.

In the quadrupole beamline magnet 10 hereinabove described in reference to FIG. 3A, the four poles 12*a*–12*d* are equiangularly positioned and are symmetric and centered at $\phi$=315°, 45°, 135°, 225°, and the four magnets 14*a*–14*d* are located midway between the poles at $\phi$=0°, 90°, 180°, 270°, respectively. Depending on the desired field distribution of each application, though, the poles 12 and the magnets 14 may be positioned with differing angular spacing therebetween, as will be apparent to those skilled in the art.

Referring back to FIG. 1, in order to eliminate interaction between the permanent magnets 14 and nearby magnets or equipment sensitive to magnetic fields, the beamline magnet 10 further preferably includes nonmagnetic end caps 34 and shield plates 36 formed of magnetically soft material, such as steel, for sandwiching the magnets 14. The end caps 34 and the shield plates 36 both define central apertures 38 and 39, respectively, which align with the central space 16 defined by the plurality of poles 12 for passing a charged particle beam therethrough. Preferably, the shape of the central apertures 38 and 39 matches the contour of the poles 12 and magnets 14, as illustrated in FIG. 1, to minimize distortions of the magnetic field, though the apertures 38, 39 may be of any shape as long as they permit passing of a charged particle beam therethrough.

In the illustrated embodiment of FIG. 1, the nonmagnetic end caps 34 define a plurality of guide channels 37, along which the magnets 14 are movably mounted. The guide channels 37 may be provided on only one of the end caps 34, though in the illustrated embodiment the guide channels 37 are provided on both of the end caps 34 for greater control of the movement of the magnets 14. In the quadrupole magnet of FIG. 1, four guide channels 37 are defined in each end cap 34 to restrict the motion of the magnets 14 along lines at 0°, 90°, 180°, and 270°, respectively. (See FIG. 3A also.) The transverse dimension "Tg" of the guide channel 37 may be slightly larger than the transverse dimension "Tm" of the magnet 14 to reduce sliding friction. The guide channels 37 may also be coated with low-friction material to reduce sliding friction and minimize wear on moving parts.

Additionally, the beamline magnet 10 may further include end magnets 40 placed on the poles 12 and/or end magnets 41 placed on the magnets 14, whose magnetization directions are oriented along a different direction from the magnetization directions of the permanent magnets 14. The end magnets 40 and 41 are used to reduce interaction between the magnets 14 and the shield plates 36.

Figure 4:
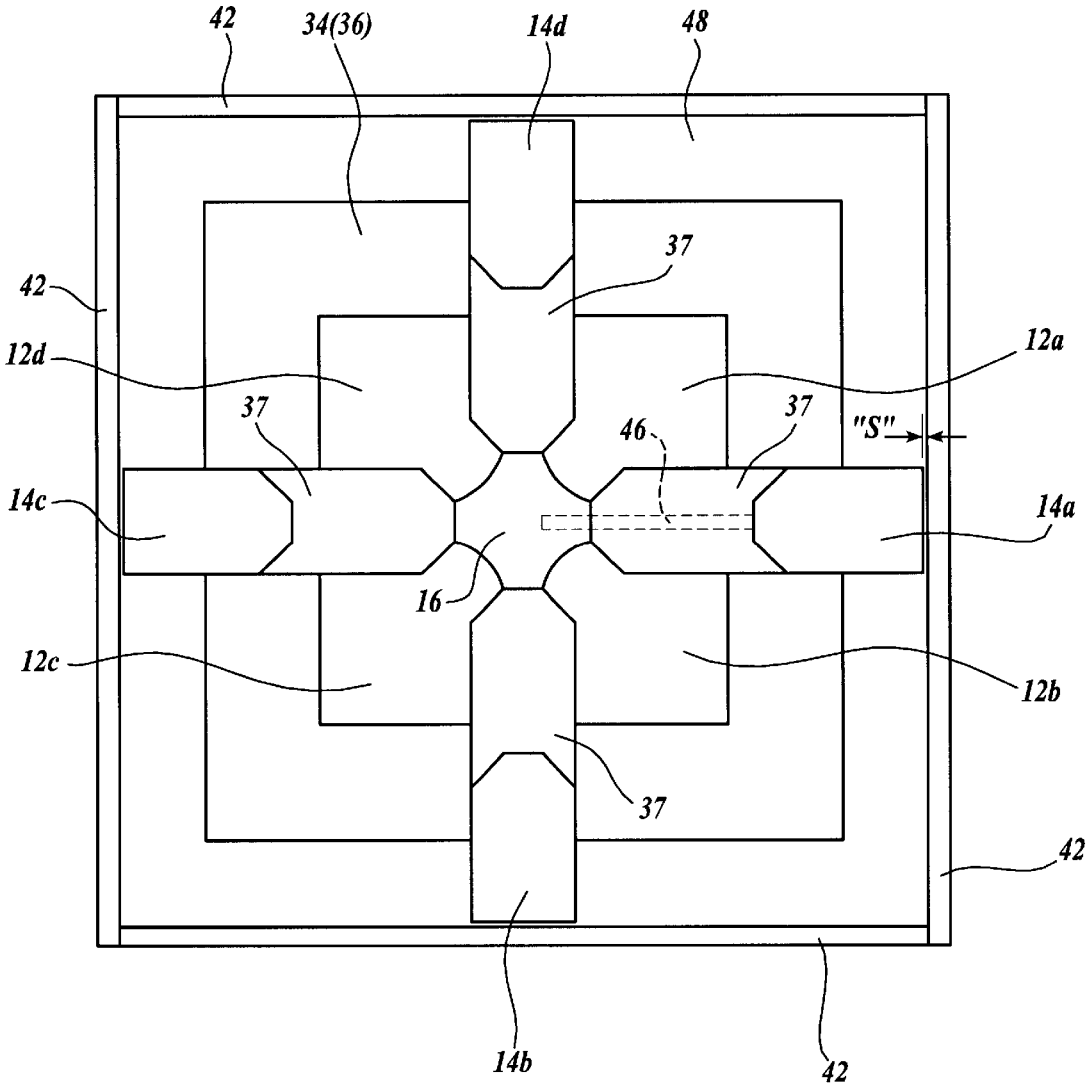
FIG. 4 is a partial cross-sectional view of the quadrupole beamline magnet of FIG. 1 taken along the x-y plane, illustrating the four poles and four magnets, an end cap, and an enclosure.

Further additionally, the beamline magnet 10 may include a surrounding magnetically soft enclosure 42 that shields neighboring equipment from stray fields. The enclosure 42 may further serve as a means of turning off the beamline magnet 10 when all the magnets 14 are withdrawn in close proximity to the enclosure 42, as illustrated in FIG. 4. In FIG. 4, all the permanent magnets 14*a*–14*d* are sufficiently retracted away from the poles 12*a*–12*d* and toward the enclosure 42 so that the poles 12*a*–12*d* are no longer magnetically coupled (i.e., the beamline magnet 10 is turned off). Instead, the magnetic flux from the permanent magnets 14 are shorted out to magnetically couple the enclosure 42. At the same time, though, space "S" is maintained between each of the magnets 14*a*–14*d* and the enclosure 42, so that moving the magnets 14*a*–14*d* away from the enclosure 42 to turn on the beamline magnet 10 will not require excessive force on the part of the linear drive 20 (see FIG. 3A). In FIG. 4, a space 48 is provided between the nonmagnetic end cap 34 (coinciding with the shield plate 36) and the enclosure 42. This arrangement may be required in an application where the shield plate 36 and the enclosure 42 need to be at different magnetic potential values. In other applications, these elements may be connected together without the space 48.

The linear drive 20 (FIG. 3A) for moving the permanent magnets 14 perpendicularly to the mechanical axis 18 may take various forms. For example, the linear drive 20 may be formed of a lead-screw 20*a* coupled to each magnet 14, wherein the rotation of the screw is translated into linear, longitudinal movement of the magnet 14. As further nonlimiting examples, the linear drive 20 may be formed of a linear motor 20*b*, linear stepper motor 20*c*, hydraulic actuator 20*d*, and cam 20*e*. Any type of devices that function to linearly move the magnets 14 in directions perpendicular to the mechanical axis 18, radially away or toward the central space 16 defined by the poles 12, may be used as a linear drive in accordance with the present invention. The choice depends on the force and precision of adjustment required for each application. Furthermore, the linear drive 20 may be coupled to the magnets 14 in various ways. For example, one linear drive 20 may be coupled to two or more magnets 14*a*–14*d* so that the linear drive 20 can collectively move the coupled magnets together. In another example, each of the magnets 14*a*–14*d* is coupled to a separate linear drive 20, as illustrated in FIG. 3A, so that each magnet is selectively and individually movable.

Linear movement of the magnets 14 to adjust the magnetic field strength and/or the magnetic centerline is straightforward and does not suffer from potential backlash problems associated with a system using rotating magnets. Also, linear movement of the magnets 14 allows for use of linear encoders 43 (i.e., electronic rulers, for example, digital micrometers) to delineate the degree of adjustment of the magnets 14, which are easier to apply and follow than angular encoders. For example, the strength setting ($\Delta B/B$) of 0.01%, typically required in an adjustable-strength beamline magnet, can be achieved with linear encoders having resolutions of 20 microns in accordance with the present invention, which are readily obtainable. In FIG. 3A, the linear encoder 43 is illustrated to have its one longitudinal end coupled to the radially back surface of the moving magnet 14*a*, and the other end coupled to a fixed point defined by the outline 25 of the end cap 34.

Optionally, a magnetic field sensor 44 may be mounted on the poles 12, as illustrated in FIG. 3A, or any locations that are close to the central space 16, to monitor the magnetic field strength. The sensed field strength may then be used to control the movement of one or more permanent magnets 14 so as to achieve the desired adjustment in the magnetic field strength and/or the magnetic centerline. For example, the sensor 44 may be coupled (not shown) to the linear drive 20 so as to automatically control the movement of the linear drive 20 until a threshold field value is detected.

The poles 12*a*–12*d* are rigidly attached to the end caps 34 by adhesives or other nonmagnetic means, such as stainless steel bolts. Still referring to FIG. 3A, preferably, the transverse dimension "Tm" of each magnet 14 is slightly smaller than the transverse dimension "Ts" of the space between the two adjacent poles 12 so as to create a small air gap between each of the poles 12 and its adjacent magnet 14. This small air gap would not substantially affect the magnetic field, but would reduce the attraction between the poles 12 and the magnets 14, thereby permitting easier movement of the magnets 14 relative to the stationary poles 12 and also preventing any inadvertent movement of the stationary poles 12.

In operation, by linearly moving one or more magnets 14 perpendicularly to the mechanical axis 18, i.e., radially outwardly or inwardly with respect to the mechanical axis 18, one may freely manipulate the magnetic field present in the central space 16. While the initial magnetic field is given based on various elements, including the size and strength of the magnets 14, the size of the poles 12, and the size of the gap between the magnets 14 and the poles 12, the field strength and the magnetic centerline can be readily adjusted by merely moving the magnets 14 linearly. According to the present invention, moving one magnet increases or decreases the amount of magnetic flux coupled to its adjacent two poles, and thus increases or decreases the magnetic potential values at those poles. Generally, selective movement of the magnets 14 affects the field distribution according to the following equation:

$$B_{new}(x+k_2,\ y+k_3,\ z)=k_1{}^*B_{old}(x,\ y,\ z) \tag{2}$$

where $k_1$, $k_2$, and $k_3$ are all arbitrary numbers. In practice, though, $k_1$ is typically 0.5 to 1.0 and $k_2$ and $k_3$ are typically less than $1/10^{th}$ of the diameter of the central space 16.

In a more special case, the beamline magnet 10 of the present invention may be used to adjust the field strength without changing the field distribution. For example, when all the magnets 14*a*–14*d* are uniformly retracted in radial directions by an equal amount, as illustrated in FIG. 2B, the magnets 14 couple less magnetic flux to the adjacent poles 12 to thereby reduce the magnetic potential values at the poles 12. As a result, the magnetic field will be essentially linearly decreased as a function of the retraction distance (i.e., the linear displacement of each magnet 14). At this time, though, since the potential values are uniformly decreased at all the poles 12, the field distribution remains substantially the same. The linear adjustment of the field strength in this case can be represented in the following equation:

$$B_{new}(x,\ y,\ z)=k_1{}^*B_{old}(x,\ y,\ z) \tag{3}$$

Figure 6:
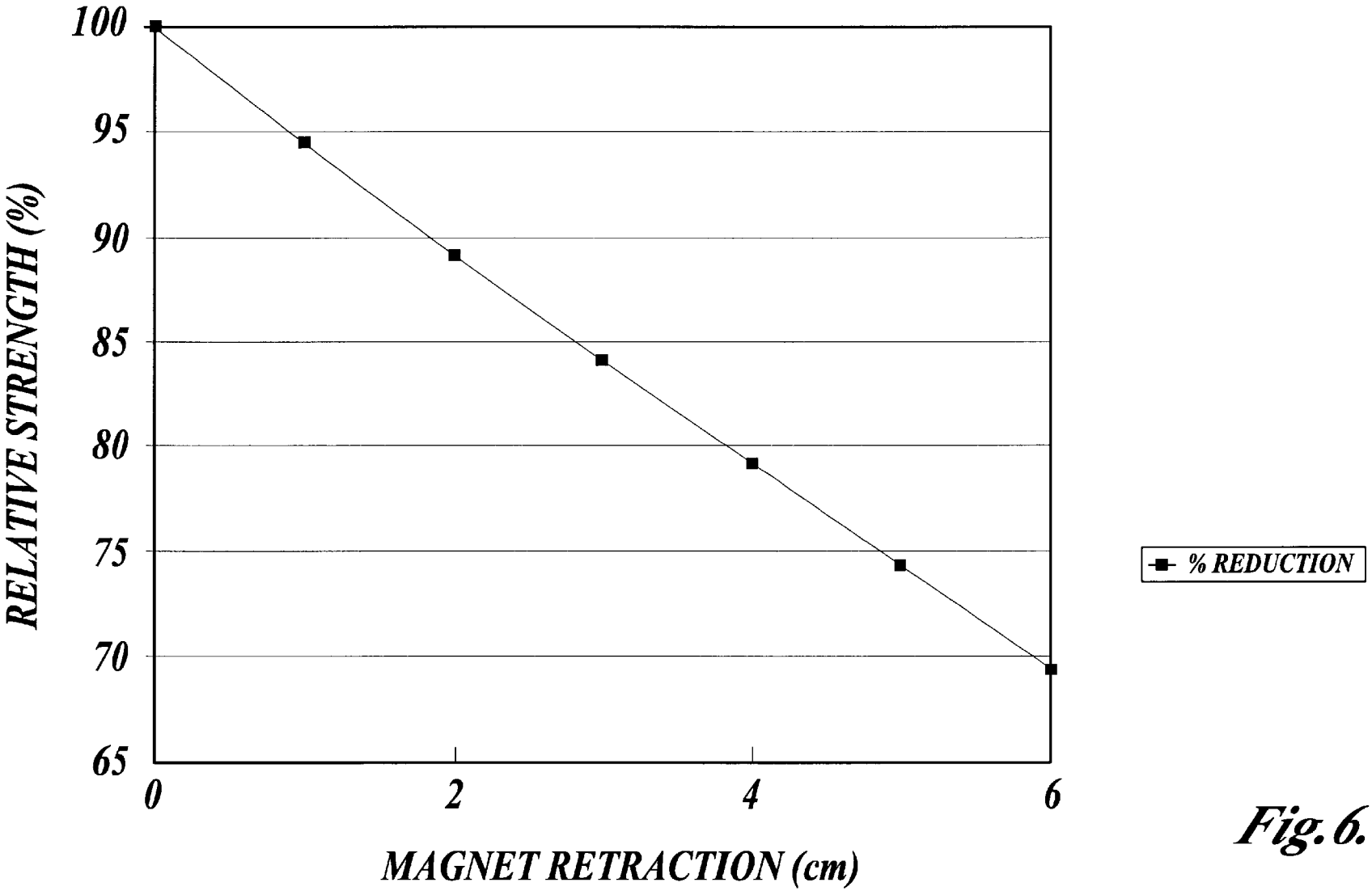
FIG. 6 is a graph of magnetic field strength change as a function of magnet retraction, illustrating linear field adjustment achievable using a beamline magnet of the present invention.

The linear adjustment of the field strength produced by the arrangement of FIG. 2B is also illustrated in the graph of FIG. 6. Since the quadrupole field varies linearly as a function of the distance from the magnetic centerline (coinciding with the mechanical axis 18 in this case), the field value is zero at the magnetic centerline (x, y)=(0, 0), and is specified as $B_{pole}=B(R_{pole})$ at particular radius $R_{pole}$ from (0, 0), which is called a "pole tip field". In FIG. 6, the vertical axis shows the reduction of the pole tip field (relative strength of the field in %) and the horizontal axis shows the retraction distance of each of the magnets 14 in cm. As illustrated, the pole tip field variation is linear over a particular retraction range. When the magnets 14*a*–14*d* are uniformly moved in an opposite direction, i.e., radially inward toward the mechanical axis 18, the field strength will increase linearly. When a larger adjustment is required, the pole tip field reduction can become non-linear. This occurs once the field is reduced below approximately one half of its maximum value.

Another method of linearly adjusting the magnetic field strength without substantially changing the field distribution is to move only one pair of opposing magnets, for example the magnets 14*a* and 14*c* in FIG. 2B, while not moving the magnets 14*b* and 14*d*. This method of adjustment works because each of the magnets 14*a* and 14*c* powers two adjacent poles (12*a* and 12*b*; and 12*c* and 12*d*, respectively). Thus, moving one pair of magnets adjusts the magnetomotive force supplied to all four poles 12. When only the magnets 14*a* and 14*c* are retracted, i.e., moved radially outward with respect to the mechanical axis 18, the pole tip field is decreased at half the rate as shown in FIG. 6.

In many applications, it is desirable to adjust the location of the magnetic centerline. In the present invention, the magnetic centerline may be adjusted by moving a pair of opposing magnets 14. In particular, as a special case of equation (2), the magnetic centerline can be shifted without changing the field strength according to the following equation:

$$B_{new}(x+k_2,\ y+k_3,\ z)=B_{old}(x,\ y,\ z) \tag{4}$$

Figure 2C:
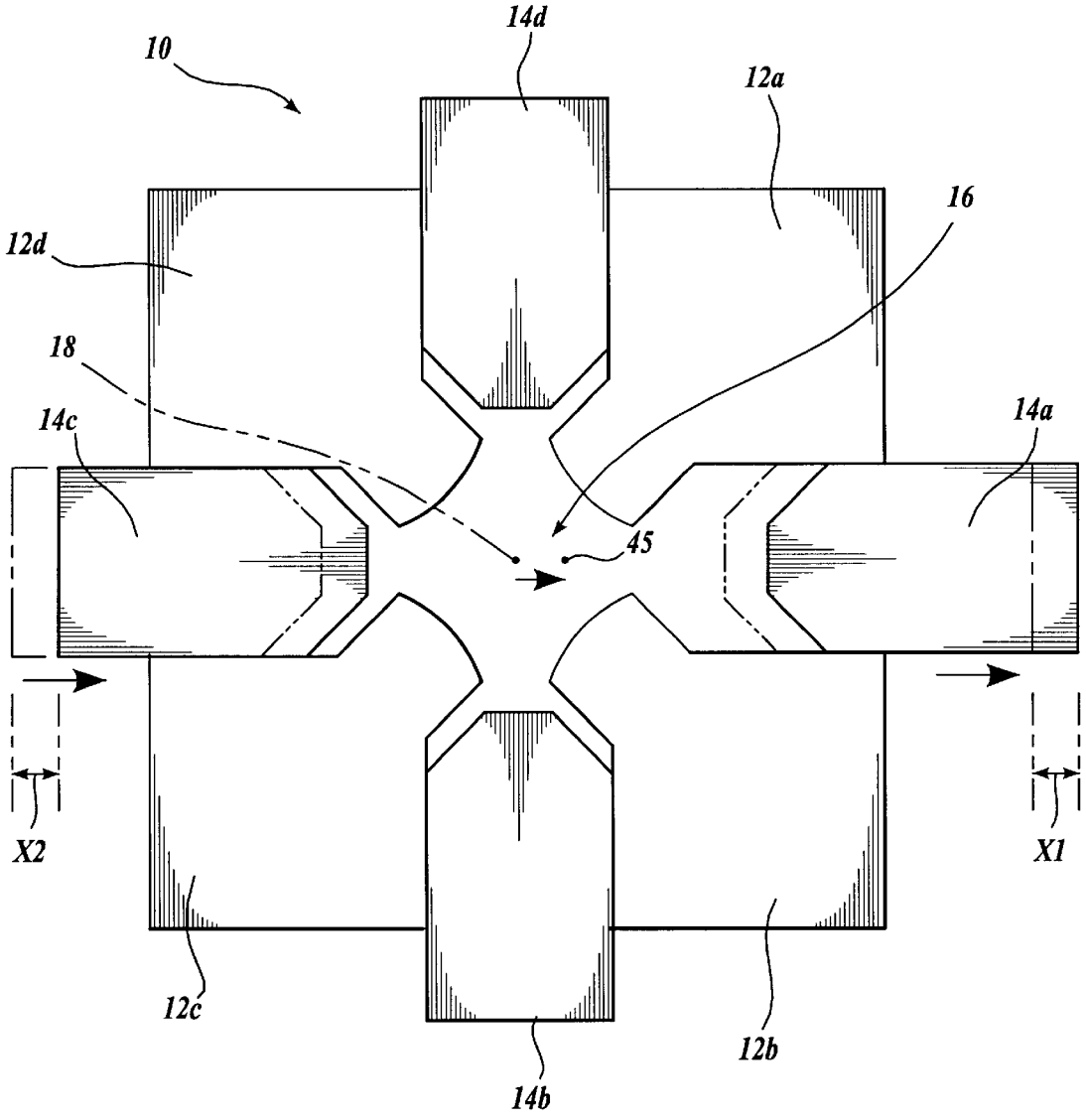
FIG. 2C illustrates the four poles and four magnets of FIG. 2A, wherein a pair of opposing magnets are collectively moved in one direction to linearly move the magnetic centerline.

For example, referring to FIG. 2C, by moving the magnets 14*a* and 14*c* perpendicularly to the mechanical axis 18 to the right by a distance X1 and a distant X2, respectively, the magnetic centerline (coinciding with the mechanical axis 18 in this case) can be moved by an amount that is a function of X1 and X2. In this case, movement of the magnet 14*a* reduces the magnetic potential of the poles 12*a* and 12*b*, while movement of the magnet 14*c* increases the magnetic potential of the poles 12*c* and 12*d*. In effect, this simply translates the equipotential lines between the poles 12*a*–12*d*, which is equivalent to a shift of the magnetic centerline. In the quadrupole geometry of FIG. 2C, the field strength varies linearly with the distance from the mechanical axis 18. Therefore, when the two magnets 14*a* and 14*c* are shifted linearly by an equal amount (X1=X2), as illustrated, the magnetic centerline is shifted from 18 to 45 without changing the magnetic field strength. The centerline shift is linear in the same direction as the movement of magnets 14*a* and 14*c*. Similar magnetic centerline adjustment is possible with a general case of multipole beamline magnets of the present invention having an even number of poles, spaced uniformly over 360°, by moving one pair of opposing magnets that are 180° apart in the same direction by an equal amount. For other multipole arrangements, it will be necessary to move magnets by different amounts to achieve the same result.

Those skilled in the art may determine the precise method of adjusting the field strength and/or the magnetic centerline based on a variety of analytical methods and experimental techniques. Furthermore, the present method of adjusting the field strength and/or the magnetic centerline can be readily applied to compensate for any variation in the magnetic strengths or magnetization directions, which may have resulted from errors that occurred during fabrication of the magnets 14. For example, the desired potential values at the poles for producing the desired field distribution may be achieved by selectively moving "stronger" magnets adjacent the poles with "higher" potential values radially outwardly until the desired potential values are reached at these poles, while not moving the rest of the magnets.

Aside from its versatile adjustability, the beamline magnet 10 of the present invention is also advantageous in that its construction permits side access to the interior of the beamline magnet 10. Specifically, referring to FIG. 4, one may access the central space 16 from a side of the beamline magnet 10 along a direction perpendicular to the mechanical axis 18, by removing one or more magnets 14 (magnet 14*a* in FIG. 4). This allows a special electron beam sensor 46 to be used along the magnetic centerline 18. The electron beam sensor 46 may be used to provide information about the behavior of the electron beam passing through the beamline magnet 10.

Strictly speaking, the magnetic field distribution is dependent on an ambient temperature in which a beamline magnet 10 is used. This is so because with many magnetic materials, the magnetic properties of the permanent magnets 14 will vary linearly with temperature. For example, neodymium iron boron has a −0.1%/C.° variation in flux production and ferrites have a −1%/C.° variation in flux production, both near room temperature. In addition, all the materials in the beamline magnet 10 may contract or expand depending on the temperature. In order to control and minimize the temperature-dependence of the magnetic field, referring back to FIG. 3A, temperature-compensating materials 47*a*–47*d* having a low Curie temperature may be magnetically coupled to the magnets 14*a*–14*d* in a "parallel flux shunt" configuration.

Figure 5:
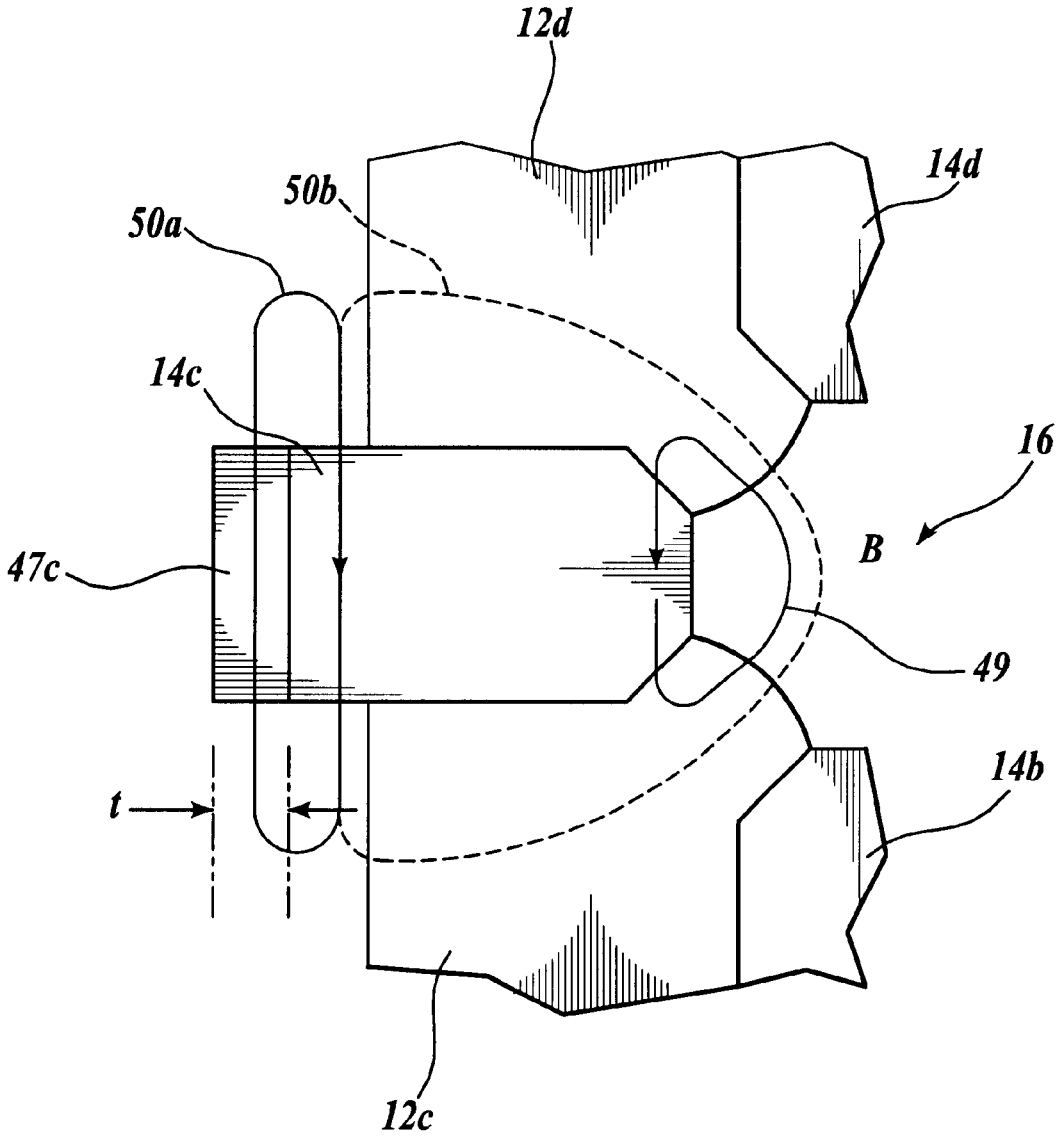
FIG. 5 is a partial view of FIG. 3A, schematically illustrating parallel flux shunting configuration, where a portion of magnetic flux is shunted away from the central space.

The temperature compensating material 47, typically steel, for example Carpenter Temperature Compensator 30 alloy, has a low Curie temperature, at which it turns from ferromagnetic to paramagnetic. When such materials 47 are magnetically coupled to the permanent magnets 14 in a parallel flux shunting configuration, the materials 47 serve to divert some flux that would otherwise be available near the central space 16 in a relatively low temperature. The flux shunting in this manner compensates for temperature-dependent flux variation of the magnets 14. Specifically, referring additionally to FIG. 5, at a low temperature, the magnets 14 are stronger than at a high temperature, and thus supplying more flux 49 near the central space 16. At a low temperature, though, the temperature compensating materials 47 shunt a larger fraction of flux 50*a* away from the central space 16 than they do at a high temperature. On the other hand, at a high temperature, the magnets 14 are weaker and thus supplying less flux near the central space 16. However, at a high temperature, the temperature compensating materials 47 shunt less flux from the central space 16, thus leaving more flux 50*b* available near the central space 16. As a result, the resulting flux in the central space 16 is substantially the same at both low and high temperatures, therefore maintaining the field strength essentially unchanged regardless of any changes in the ambient temperature.

The temperature compensation material 47 may be placed in a wide variety of locations. One preferred location is on the radially back surface of the permanent magnets 14 (or the submagnets 30), as illustrated in FIG. 3A, where it is easy to keep the material 47 from interfering with other parts of the beamline magnet 10. Alternatively or additionally, the temperature compensating material 47 could be embedded in the nonmagnetic end caps 34, to which the permanent magnets 14 and the poles 12 are attached. An equally effective configuration for the temperature compensating material 47 is one that bridges the outer surfaces 51 of the adjacent poles 12, as illustrated in a broken line 52. This is a more complex arrangement, though, because the temperature compensating material 47 must be configured to avoid interfering with the linear movement of the magnets 14.

When temperature compensating material 47 is used, it produces a linear temperature dependence to the multipolar strengths, $a_n$ and $b_n$, of the beamline magnet 10 in equation (1), which in turn could produce temperature independence of the field strength of the magnetic beamline 10. As noted above, one example of temperature compensating material is Carpenter Temperature Compensator 30 Alloy. The magnetic permeability of this material is roughly linear between 5C.° and 50C.°. When this alloy 47 is used at location on the back of the permanent magnets 14 (or submagnets 30), as illustrated in FIG. 3A, the magnetic field strength $b_1$ of a quadrupole varies linearly with temperature T and compensating steel thickness t (see FIG. 5), according to the following equation:

$$b_i(T,t)=(b_1(0,0)+(at-b)(T-T_0)-ct) \quad (5)$$

where $b_1(0,0)$=quadrupole field strength without temperature compensation;

a=change in the temperature dependence due to compensating material 47;

t=thickness of compensating material 47;

b=linear temperature dependence of the strengths of magnets 14;

T=temperature of magnet 14 and compensating material 47;

$T_0$=nominal operating temperature; and c=field strength loss due to compensating material 47 per thickness.

The coefficients a, b, and c are all >0. For example, NdFeB magnetic material has b=0.1%/C.°. The values of a and c depend on the compensating material chosen, the field strength at the radially back surface of the magnets 14 to which the material 47 is attached, and the actual shapes of the magnets 14 and poles 12. Their values can be determined by analysis or direct measurements. When the compensating material thickness t is zero, the quadrupole field strength $b_1(T,0)$ has a linear temperature dependence. When the compensating material thickness t is b/a, the quadrupole field strength will be independent of temperature but reduced by c*b/a. In one particular design with NdFeB magnets, b was 0.1%/C.°, a was 0.0111%/(mm*C.°) and c was 0.4444%/mm, and perfect temperature compensation for maintaining a temperature-independent field strength at an essentially constant level required 9 mm-thick compensating material 47 (Carpenter Temperature Compensator 30 alloy) placed on each of the four magnets 14, with a 4% reduction in the field strength.

It should be clear from equation (5) that in order to correct the quadrupole field strength $b_1$ for the temperature dependence of the strengths of the magnets 14, only the total thickness of the compensating material 47 placed on one or more magnets 30 matters. Specifically, the total thickness divided by the number of the magnets 30 to which the compensating material 47 is magnetically coupled, i.e., the average thickness of the compensating material per magnet matters. Thus, the compensating material 47 could be placed on any number of the magnets 14 in equal or different amounts. As long as the average thickness remains the same, the effect of placing the temperature compensating material 47 remains the same.

Some applications will require extremely tight control of the magnetic centerline. However, as with the field strength discussed above, the magnetic centerline may shift due to changes in the ambient temperature. For example, expansion/contraction of a platform 53 (FIG. 3A) supporting the beamline magnet 10 results in the centerline shift. As an example, if the support platform 53 is made from aluminum that is 10 cm in height "H", then the magnetic centerline could move 2 microns per C.° relative to a fixed bottom surface 54 formed of, for example, a piece of granite.

According to the present invention, thermal compensation of the centerline shift is achieved by coupling different amounts of temperature compensating material 47 on each magnet. If the thickness t of temperature compensating material 47 attached to the radially back surfaces of the magnets 14 (or submagnets 30 in FIG. 3A) differs amongst the magnets 14, the strengths (flux coupling) of the magnets 14 will vary with temperature at different rates. This will produce an equivalent movement of the magnetic centerline, which can be designed to compensate for any undesirable temperature-induced movement of the magnetic centerline. Specifically, referring back to FIG. 2C, the magnetic centerline is shifted from point 18 to point 45 when the magnet 14*c* is inserted and the opposing magnet 14*a* is retracted by the same amount, to increase and reduce the magnetic potential values at the poles 12*c*/12*d* and 12*a*/12*b* by an equal amount, respectively. Therefore, the centerline shift depends on the difference between the strengths of essentially opposing magnets 14*c* and 14*a*. In an equivalent manner, by adding more temperature compensating material 47*a* to magnet 14*a* and less temperature compensating material 47*c* to magnet 14*c*, the magnetic centerline will shift linearly (toward the right in FIG. 3A) with temperature increase. Such adjustment can be used to compensate for an undesirable temperature-induced shift of the magnetic centerline toward the left in FIG. 3A with temperature increase. By using suitable analytical or experimental methods, one may adjust the degree of centerline shift to compensate for any undesirable temperature-induced shift of the centerline. With proper choice of the temperature compensating material 47, its dimensions and location, the magnetic centerline can be maintained at an essentially constant location despite changes in the operating temperature.

As long as the average compensating material thickness of 47*a* and 47*c* is chosen to be equal to b/a in equation (5), the magnetic strength $b_1$ will be independent of temperature while the centerline will move linearly with temperature.

Figure 7:
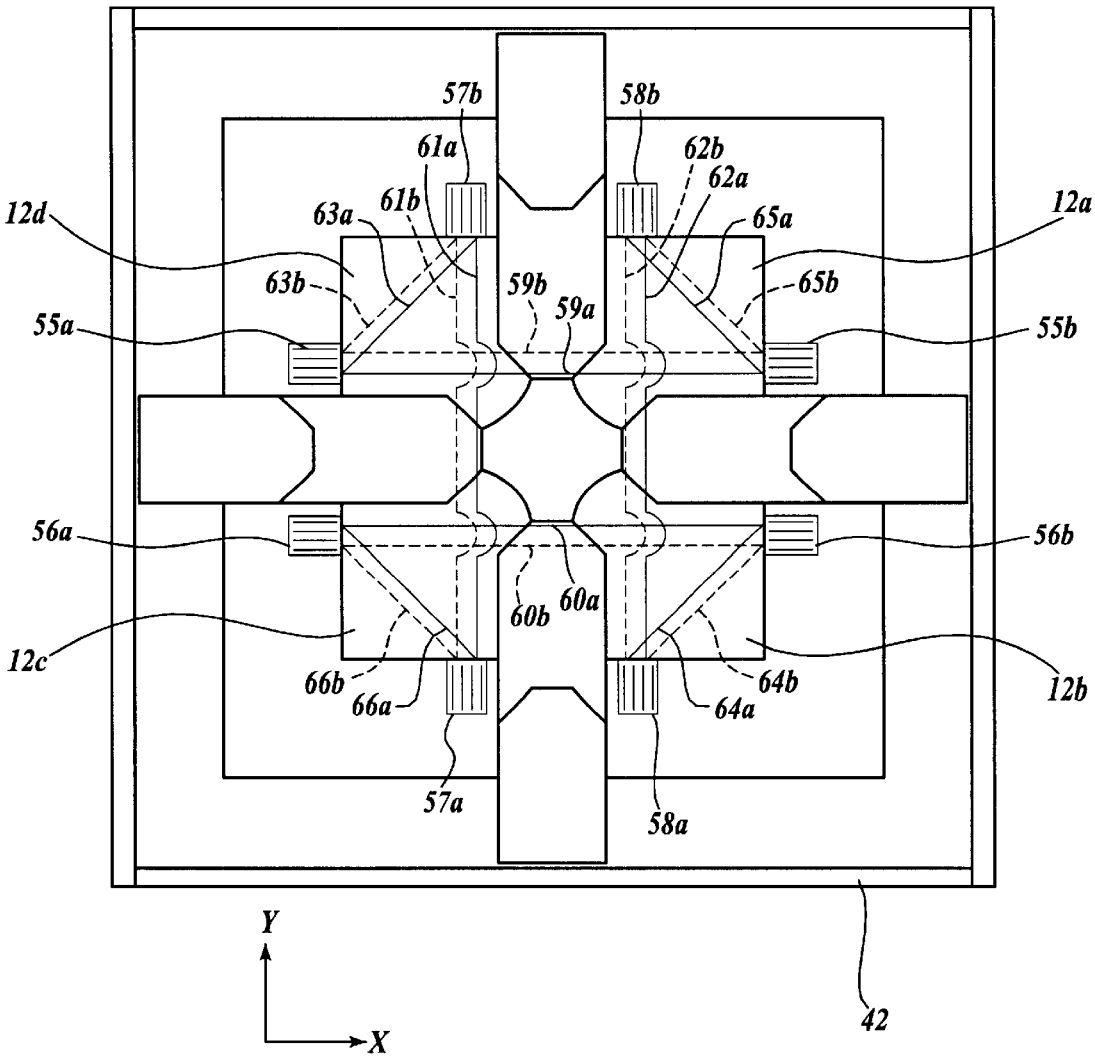
FIG. 7 is the beamline magnet of FIG. 4, further schematically illustrating electromagnetic corrector coils.

Next, referring to FIG. 7, an additional means of adjusting the magnetic field strength and/or the magnetic centerline of the beamline magnet 10 of the present invention is described.

In FIG. 7, the beamline magnet further includes electromagnetic corrector coils 55*a*, 55*b*, 56*a*, 56*b*, 57*a*, 57*b*, 58*a*, and 58*b*. The corrector coils are used, in addition to linear movement of the magnets 14, for the purpose of quickly making fine or trim adjustments in the field strength and/or the magnetic centerline. In most applications, the coils 55*a*–58*b* carry low currents to provide small adjustments. Thus, the coils 55*a*–58*b* can be readily air cooled, and do not require more complex cooling means such as water cooling.

In operation, the coils 55*a*–58*b* are selectively energized to supply suitable magnetomotive forces to their adjacent poles 12. To this end, the coils 55*a*–58*b* may be wrapped around the poles 12*a*–12*d* via lines 59*a*–66*b*, as illustrated. In FIG. 7, solid lines 59*a*–66*a* cross "over" the poles 12 and broken lines 59*b*–66*b* cross "behind" the poles 12. Alternatively, the coils 55*a*–58*b* may be connected to a terminal strip for selective energization. In any event, all the coils are connected to a suitable power supply (not shown).

When a centerline adjustment in a vertical direction (y direction) is desired, the coils would be wired in such a way that they supply the same amount of magnetomotive force to the upper two poles 12*a* and 12*d*. The lower two poles 12*b* and 12*c* would be supplied with an equal but opposite magnetomotive force. One way of providing these polarities to the magnetomotive force is to pass a current successively through the coil 55*a*, line 59*a*, coil 55*b*, and line 59*b*; and the coil 56*a*, line 60*a*, coil 56*b*, and line 60*b*. Other wiring configurations are equally possible, as will be apparent to those skilled in the art. Also, it should be appreciated that the orientation of the coils 55*a*–58*b* is not limited to the illustration of FIG. 7, and may be varied depending on each application, similarly to how the magnetization directions of the permanent magnets 14 may vary.

When a centerline adjustment in a horizontal direction (x direction) is desired, the coils would be wired in such a way that they supply the same amount of magnetomotive force to the right two poles 12*a* and 12*b*. The left two poles 12*c* and 12*d* would be supplied with an equal but opposite magnetomotive force. One way of providing these polarities to the magnetomotive force is to pass a current successively through the coil 57*a*, line 61*a*, coil 57*b*, and line 61*b*; and the coil 58*a*, line 62*a*, coil 58*b*, and line 62*b*. As before, other wiring configurations and coil orientations are possible.

When a field strength adjustment is desired, without shifting a magnetic centerline, the coils would be wired in such a way that they supply the same amount of magnetomotive force to all four poles, so as to universally increase or decrease the potential values of all four poles. One way of providing these polarities to the magnetomotive force is to pass a current successively through the coil 55*a*, line 63*a*, coil 57*b*, and line 63*b*; the coil 58*b*, line 65*a*, coil 55*b*, and line 65*b*; the coil 56*b*, line 64*a*, coil 58*a*, and line 64*b*; and the coil 57*a*, line 66*a*, coil 56*a*, and line 66*b*. As before, other wiring configurations and coil orientations are possible.

By merely varying the amount of current passing through the coils 55*a*–58*b*, quick and precise adjustment of the magnetic centerline, in both vertical and horizontal directions, and also adjustment of the field strength can be achieved. It should be apparent to those skilled in the art that when both centerline and strength adjustments are required, each of the coils 55*a*–58*b* could be separated into subcoils, as illustrated in FIG. 7. For example, if coil 55*a* has 100 turns then 30 turns could be wired to carry the strength corrector current and the remaining 70 turns could be wired to carry the vertical centerline adjustment current. It should also be apparent that the locations of the corrector coils 55*a*–58*b* are not limited to the back surfaces 51 of the poles 12 as illustrated, and the coils 55*a*–58*b* may be placed in other locations as long as they can supply predefined magnetomotive force to the poles 12 to effect necessary adjustments.

Figure 8A:
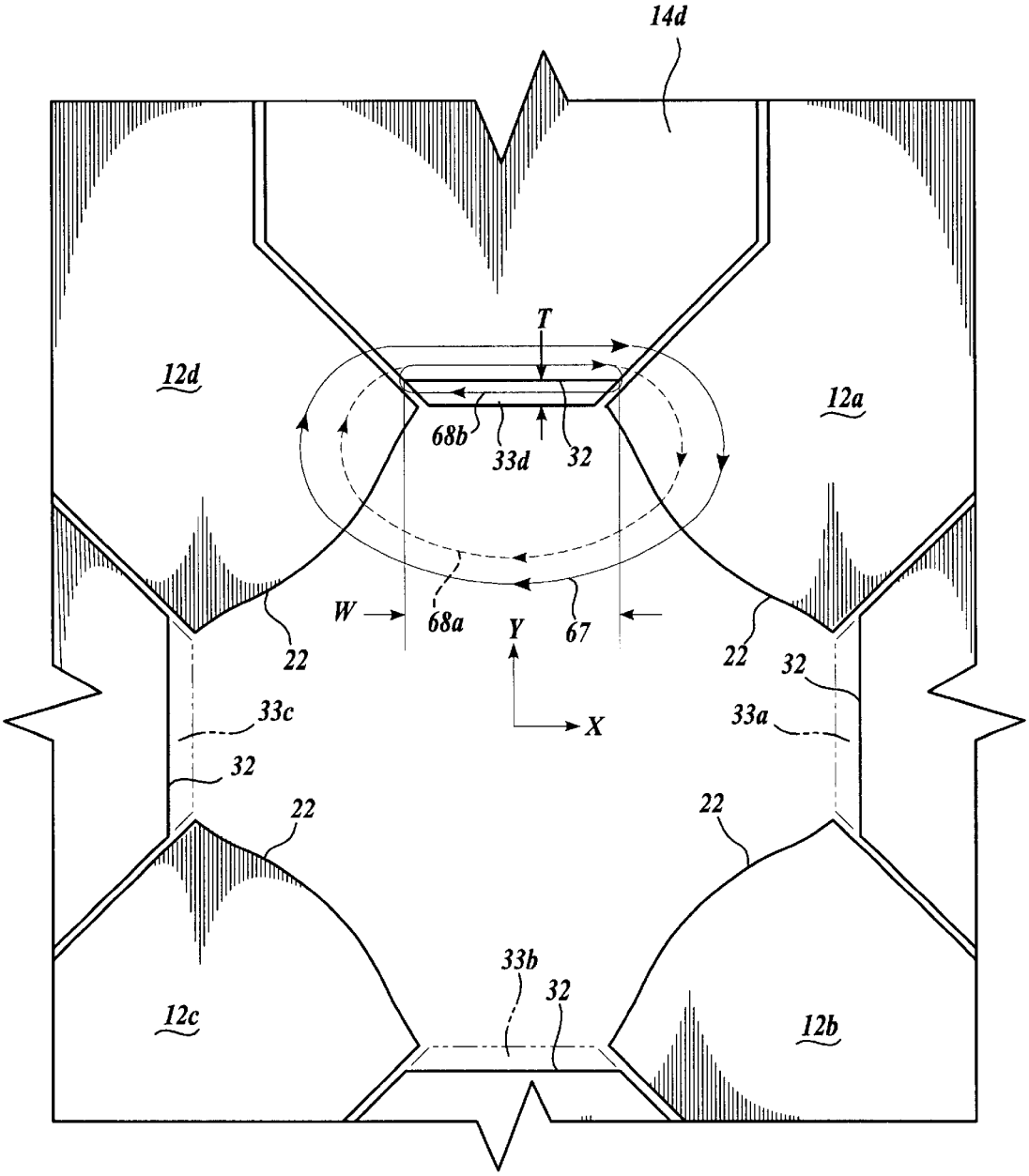
FIGS. 8A and 8B are partial plan views of the four poles and four magnets of FIG. 1, including shims attached to the faces of the permanent magnets.

Now referring back to FIG. 3B and additionally to FIG. 8A, the tuning shims 33 are described in more detail. As briefly discussed above, the shims 33 are used to correct various types of field errors, such as field strength errors, magnetic centerline errors, or field distribution errors (distortions), which are created due to imperfection in the fabrication process of the magnets 14 and/or the poles 12. The shims are made of any ferromagnetic material such as low carbon steel, nickel, or steel/nickel alloys. When a large correction of a few percent of the field strength is needed, low carbon steels are preferred. For smaller corrections, nickel or steel-nickel alloys are preferred. Preferred locations for the shims 33 are on the faces 32 of the magnets 14, as illustrated in FIG. 8A. The reason for this is that the shims 33 (or their magnetic moment) align themselves with the local magnetic field, which is parallel to the magnet faces 32. Therefore, when the magnet face 32 is planar as illustrated in FIG. 8A, the shims 33 formed in a simple flat shape are naturally held in place by the magnets 14 due to magnetic attraction. The shims 33 may also be attached to the magnets 14 using adhesive if necessary. This is in contrast to the stationary poles 12, where the local magnetic field is perpendicular to the equipotential pole faces 22. Therefore, when shims are placed adjacent to the pole faces 22, the shims will align themselves perpendicularly to the pole faces 22 (sticking out into the central space 16), which is undesirable. Accordingly, attaching shims on the poles 12 in parallel with the pole faces 22 would require additional attachment means such as adhesive. Shims placed on the poles 12 will produce about ten times larger correction than the shims placed on the magnets 14, but for most applications such a large correction is not needed. The shims may be placed in other locations, such as on the nonmagnetic end caps 34 or on the end magnets 40, 41, as long as the direction of the field created by the shims opposes the direction of the erroneous field to be corrected, as more fully described below.

Referring specifically to FIG. 8A, four shims 33*a*–33*d* are respectively placed on the faces 32 of the four magnets 14*a*–14*d*. The following description focuses on one shim 33*d*, though of course the same description equally applies to the other shims 33*a*–33*c* also. The shape of the magnetic field produced by the shim 33*d* is mainly determined by the width "W" of the shim 33*d* on the magnet 14*d* and by the length of the shim 33*d* along the magnetic centerline (along the z-axis). The shim 33*d* can be thought of as an essentially uniform magnet that is polarized by the magnet 14*d*. The direction of the field created by the shim 33*d* opposes the direction of the field created by the magnet 14*d* to which it is attached, because the shim 33*d* is a shunt, i.e., the shim diverts flux away from the central space 16. For example, as schematically illustrated, while flux lines 67 and 68*a* would be available near the central space 16 when no shim is used, the flux line 68*a* will be diverted to 68*b* when the shim 33*d* is coupled to the magnet 14*d*. Thus, the length and width "W" of the shim 33*d* will affect the magnetic field shape that is produced. The correction effect (i.e., correction magnitude) of the shim 33*d* is essentially linear with the radial thickness T because the shim 33*d* is saturated. The flux shunted by the shim 33*d* is then the saturation induction of the steel chosen to form the shim 33*d* multiplied by the cross-sectional area of the shim (the length multiplied by the radial thickness T).

The fields produced by the shims 33*a*–33*d* superimpose. Once the field from a single shim is determined by experimental or analytical means, the fields from a multiplicity of shims can be determined by addition of vectors. A particularly convenient way of doing this uses equation (1). Specifically, equation (1) can be used to describe the field characterized by a set of multipole coefficients, $a_n$ and $b_n$, for the shim itself. These coefficients can be determined either by experiments or analyses. Once the coefficients for the shim are known, then the effect produced when the same shim is placed on a different magnet can be found by using equation (1) to express the integrated field vectors for each multipole. The correction field produced by a shim rotates with the shim and it is also rotated whenever the magnet direction changes.

Methods of using shims to correct centerline errors and field strength errors are now described. In FIG. 8A, the shim 33*d* covers the entire face 32 having a width "W" of one magnet 14*d*. This makes the magnet 14*d* weaker, which is equivalent to retracting the magnet 14*d* from its radially innermost position along one axis. Thus, essentially, any adjustment that requires retraction of certain magnets can be achieved by attaching the shims 33*a*, 33*b*, 33*c*, and/or 33*d* on those magnets 14*a*, 14*b*, 14*c*, and/or 14*d*, respectively. The radial thickness T of a shim corresponds to the amount of retraction; the thicker the shim, the weaker the magnet to which the shim is attached. For example, pairs of shims having the same radial thickness T placed on opposing faces (33*a* and 33*c*; and/or 33*b* and 33*d*) can be used to reduce the field strength without changing the magnetic centerline, which is equivalent to simultaneously and uniformly retracting opposing pairs of permanent magnets 14 radially outwardly. For shifting the magnetic centerline, shims of unequal radial thickness may be applied to a pair of opposing faces, which is equivalent to retracting the magnets by unequal amounts.

Figure 8B:
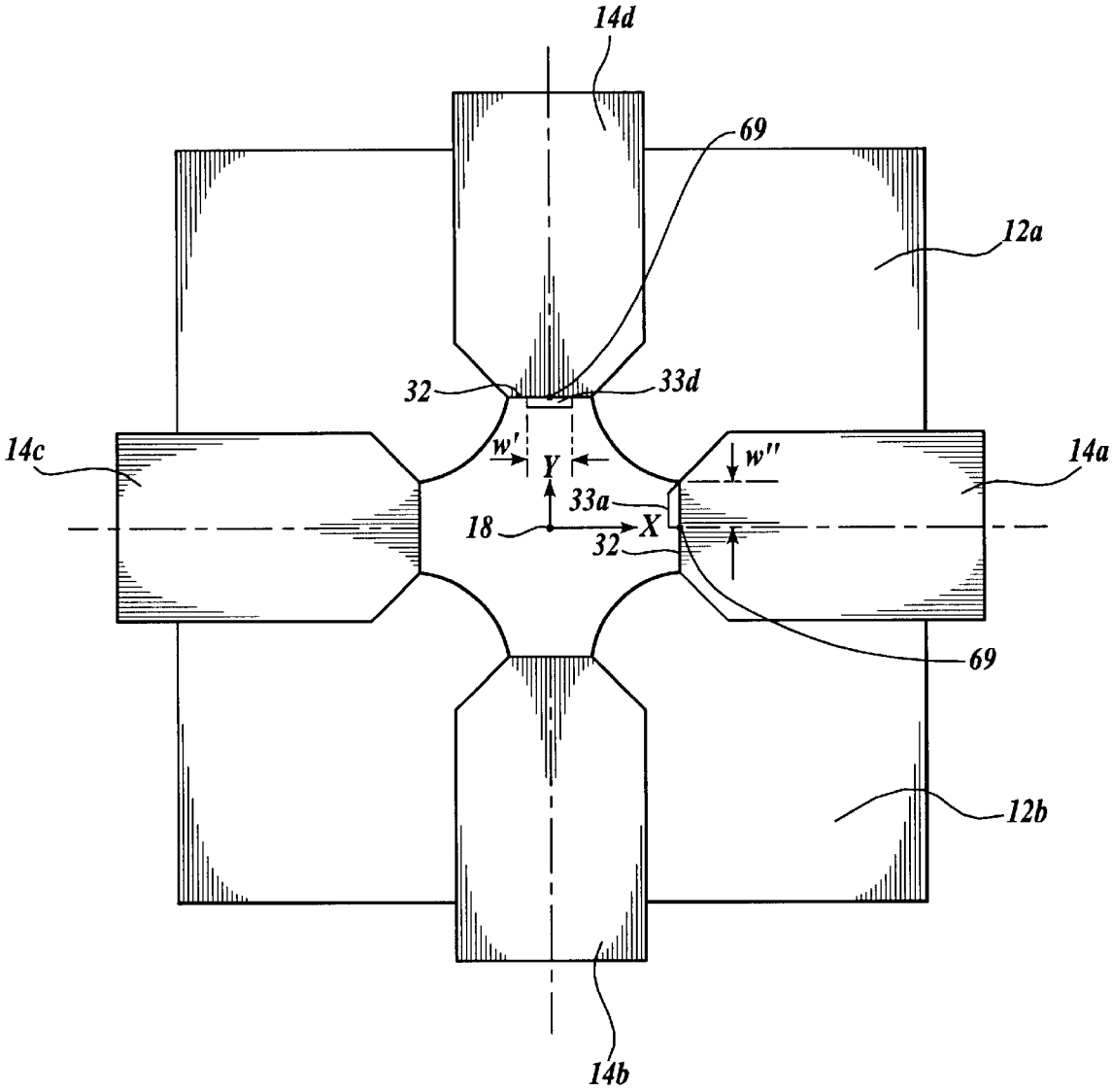

In some applications it will be necessary to correct higher-order errors, which result in localized distortion of the field distribution. Such correction also can be done with shims. Referring to FIG. 8B, if the shim 33*d* does not cover the entire face 32 width of the magnet 14*d* (covering only a partial width W' of the face 32), then it will create a high order correction field suitable for correcting the localized distortion of the field. For example, if four shims are symmetrically (with respect to the axial centerline 69 of each magnet, extending in the z direction in parallel to the mechanical axis 18) applied on all four magnets in the quadrupole beamline magnet, respectively, but only covering over 50% width of each magnet face, as is the shim 33*d*, then an octupole correction field will be produced. Likewise, if partial shims covering only 50% width of magnet faces are placed at one pair of opposing magnets, and if they have unequal radial thickness, then the magnetic centerline will be shifted and a sextupole correction field will be produced. It should be noted that a partial shim, such as the shim 33*d*, may or may not cover the entire length of the magnet face 32 along the axial centerline 69 (i.e., along the z direction). For example, the shim 33*d* may be covering only a partial length of the magnet face 32 along the axial centerline 69, and may further be displaced to any location along the axial centerline 69, depending on the desired correction field required in each application. Likewise, any shim that covers the entire width of the magnet face 32 (e.g., the shims 33*a*–33*d* in FIG. 8A) also may or may not cover the entire length of the magnet face 32 along the z direction. Generally, displacing a shim along the axial centerline 69 (the z direction) causes the correction field created by the shim to be also displaced along the same direction.

In addition, still referring to FIG. 8B, if the partially covering shim is not symmetrically applied relative to the axial centerline 69 of the magnet 14*a* (see the shim 33*a*), then the correction field will also become asymmetric. For example, when the correction field is displaced relative to the axial centerline 69 along the y direction in the case of the shim 33*a*, the shim's affect on the strengths of the poles 12*a* and 12*b* will become asymmetric. This is an efficient way of mixing the $a_n$ and $b_n$ coefficients in equation (1). Specifically, in an ideal quadrupole beamline magnet, the only nonzero multipolar coefficient is $b_1$. However, in practice, there will be many nonzero coefficients. By selectively miscentering shims with respect to the axial centerline 69, while carefully adjusting the width and radial thickness of each shim, one may adjust the relative strengths of the poles 12*a*–12*d*, so as to reduce nonzero multipolar coefficients to acceptable levels close to zero. As before, any shim that is not symmetric with respect to the axial centerline 69 also may or may not cover the entire length of the magnet face 32 to which it is attached. For example, the partial shim 33*a* may be only partially covering the length of the face 32 along the axial centerline 69, and further may be displaced along the axial centerline 69 to any location, depending on the particular correction field required in each application.

Various configurations and locations of shims are possible to achieve different field corrections as desired. As will be apparent to those skilled in the art, the precise impact of particular shims on the pole strengths and the field can be determined based on a variety of analytical models, for example a symmetry-based model, or based on direct measurement. Further details of application of shims in general, in particular a method of measuring the effect of shims and using the measurement to optimize configurations and location of the shims, can be found in U.S. Pat. No. 5,010,640, which is explicitly incorporated herein.

Figure 9:
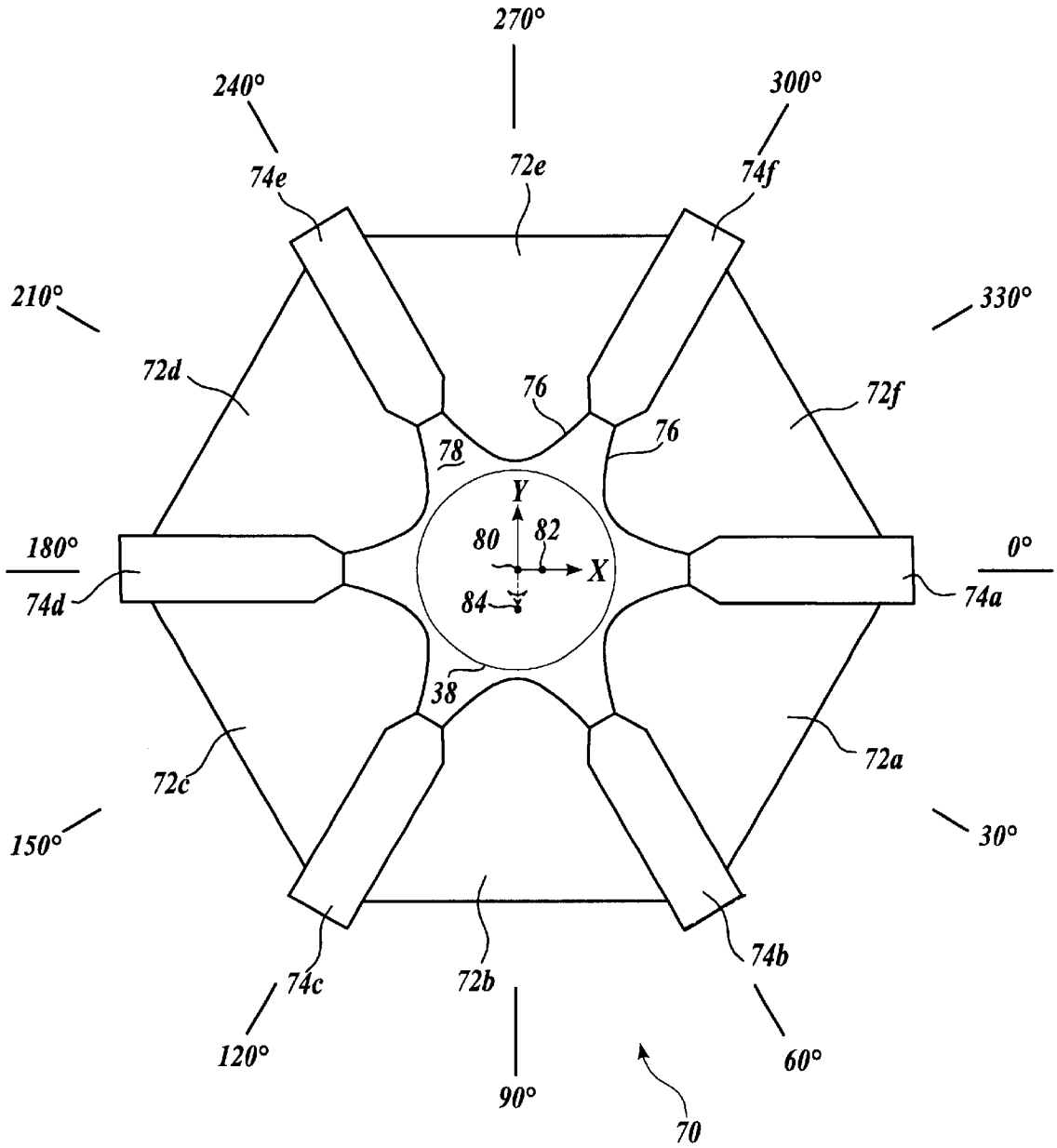
FIG. 9 is a plan view of a sextupole beamline magnet comprising six stationary poles and six movable magnets, formed in accordance with the present invention.

While the above description is directed to a specific quadrupole application of the present invention, as will be apparent to those skilled in the art, any other multipole applications are equally possible and may be readily constructed in accordance with the present invention. As a specific example, referring to FIG. 9, a sextupole beamline magnet 70 may be formed including six poles 72 located at $\phi$=30°, 90°, 150°, 210°, 270°, 330°. Six magnets 74*a*–74*f* are located at $\phi$=0°, 60°, 120°, 180°, 240°, 300°. In the sextupole beamline magnet 70, the pole faces 76 that interface the central space 78 defined by the poles 72 preferably have an "$R^3$*sin(3$\theta$)" (=constant) shape, where $\theta$ is an angle with respect to the x axis as well known in the art, to create a high-quality sextupolar field pattern.

As in the case of the quadrupole application, uniform radially outward and inward movement of all six magnets 74*a*–74*f* produces linear field decrease and increase, respectively, as a function of the distance by which the magnets 74*a*–74*f* are moved. If the magnet 74*a* at 0° is moved away from the mechanical axis 80 by one unit and the magnets 74*c* and 74*e* at 120° and 240°, respectively, are moved toward the mechanical axis 80 by two units, then the magnetic centerline initially coinciding with the mechanical axis 80 will be moved by an amount proportional to the one unit along the 0° axis to a new position 82. More generally, if the 120° magnet 74*c* is moved toward the mechanical axis 80 by x, the 240° magnet 74*e* is moved away from the mechanical axis 80 by y, and the 0° magnet 74*a* is moved toward the mechanical axis 80 by (x−y)/2, the magnetic centerline initially coinciding with the mechanical axis 80 will be shifted by an amount proportional to (x−y) along the 90° axis to a new position 84. In the last described centerline shifting method, an additional symmetric (i.e., radially inward or outward) movement of the magnets can be superimposed to compensate for any decrease or increase in the sextupole field strength. The net effect is that the sextupole magnetic centerline can be shifted without any change in the field strength.

While the preferred embodiments of the invention have been illustrated and described, it will be appreciated that various changes can be made therein without departing from the spirit and scope of the invention.

The embodiments of the invention in which an exclusive property or privilege is claimed are defined as follows:

1. A multipole beamline magnet capable of selectively adjusting a magnetic field, comprising:

a plurality of stationary ferromagnetic poles;

one or more permanent magnets disposed between the plurality of stationary ferromagnetic poles, each of the permanent magnets supplying magnetomotive force to two adjacent stationary ferromagnetic poles, thereby causing the stationary ferromagnetic poles to produce a magnetic field in a central space defined by the stationary ferromagnetic poles, wherein a mechanical axis of the beamline magnet extends through the central space perpendicularly to a plane defined by the poles and the permanent magnets; and a linear drive configured for moving the one or more permanent magnets perpendicularly to the mechanical axis.

2. The multipole beamline magnet of claim 1, further comprising nonmagnetic end caps that sandwich the poles and the magnets.

3. The multipole beamline magnet of claim 2, wherein the end cap defines one or more guide channels for movably mounting the one or more permanent magnets, respectively.

4. The multipole beamline magnet of claim 1, wherein the linear drive is selected from the group consisting of a lead-screw, a linear motor, a linear stepper motor, a hydraulic actuator, and a cam.

5. The multipole beamline magnet of claim 1, further comprising a magnetic field sensor arranged to determine the strength of the magnetic field produced in the central space.

6. The multipole beamline magnet of claim 1, wherein at least two permanent magnets are provided.

7. The multipole beamline magnet of claim 6, wherein at least two linear drives are provided and each of the permanent magnets is coupled to each of the linear drives.

8. The multipole beamline magnet of claim 6, wherein all the permanent magnets are formed in an equal shape.

9. The multipole beamline magnet of claim 6, wherein at least two permanent magnets have different magnetization directions.

10. The multipole beamline magnet of claim 6, wherein the permanent magnets are disposed equiangularly.

11. The multipole beamline magnet of claim 1, wherein at least one of the one or more magnets is formed in a shape selected from the group consisting of: a rectangular shape; a rectangular shape with at least one of its four corners chamfered; a wedge shape; and a combination of a rectangular shape and a trapezoidal shape.

12. The multipole beamline magnet of claim 1, wherein at least one of the one or more permanent magnets comprises a plurality of submagnets, which are combined to form the permanent magnet.

13. The multipole beamline magnet of claim 12, wherein the plurality of submagnets for forming the permanent magnet are fabricated in different shapes.

14. The multipole beamline magnet of claim 12, wherein a first submagnet that is positioned farthest away from the mechanical axis has a first magnetization direction to form a corrector magnet, and a second submagnet adjacent the first submagnet has a second magnetization direction that is different from the first magnetization direction.

15. The multipole beamline magnet of claim 1, further comprising one or more stationary auxiliary magnets provided between the central space and the one or more permanent magnets, respectively.

16. The multipole beamline magnet of claim 15, wherein the stationary auxiliary magnet and its adjacent permanent magnet have an equal magnetization direction.

17. The multipole beamline magnet of claim 15, wherein the stationary auxiliary magnet and its adjacent permanent magnet have different shapes.

18. The multipole beamline magnet of claim 1, further comprising a tuning shim for correcting a field error, wherein a direction of a field produced by the tuning shim opposes a direction of an erroneous field.

19. The multipole beamline magnet of claim 18, wherein the tuning shim is coupled to one of the one or more permanent magnets on the magnet's face interfacing the central space.

20. The multipole beamline magnet of claim 19, wherein the tuning shim is configured to cover an entire width of the magnet's face interfacing the central space.

21. The multipole beamline magnet of claim 19, wherein the tuning shim is configured to partially cover an width of the magnet's face interfacing the central space.

22. The multipole beamline magnet of claim 21, wherein the tuning shim is asymmetrically applied with respect to an axial centerline of the magnet.

23. The multipole beamline magnet of claim 21, wherein the tuning shim is symmetrically applied with respect to an axial centerline of the magnet.

24. The multipole beamline magnet of claim 19, wherein the tuning shim is configured to cover an entire length of the magnet's face interfacing the central space.

25. The multipole beamline magnet of claim 19, wherein the tuning shim is configured to partially cover a length of the magnet's face interfacing the central space, the shim being positioned at a predetermined location along an axial centerline of the magnet.

26. The multipole beamline magnet of claim 1, further comprising an end magnet.

27. The multipole beamline magnet of claim 1, further comprising a pair of ferromagnetic shield plates sandwiching the poles and the magnets.

28. The multipole beamline magnet of claim 1, wherein a pole face of at least one of the stationary poles comprises an equipotential surface.

29. The multipole beamline magnet of claim 1, further comprising a temperature compensating material that is magnetically coupled to the one or more permanent magnets in a parallel flux shunt configuration.

30. The multipole beamline magnet of claim 29, wherein the temperature compensating material is attached to a radially back surface of the one or more permanent magnets.

31. The multipole beamline magnet of claim 29, wherein the temperature compensating material is attached to the plurality of stationary poles.

32. The multipole beamline magnet of claim 29, wherein at least two permanent magnets are provided, and temperature compensating material is attached to the at least two permanent magnets in an equal amount.

33. The multipole beamline magnet of claim 29, wherein at least two permanent magnets are provided, and temperature compensating material is attached to the at least two permanent magnets in different amounts.

34. The multipole beamline magnet of claim 1, further comprising a plurality of electromagnetic corrector coils, the coils being configured to be selectively wired and to selectively pass an electric current therethrough so as to supply predefined magnetomotive force to the plurality of stationary poles.

35. The multipole beamline magnet of claim 34, wherein the electromagnetic corrector coils are placed adjacent radially outer surfaces of the stationary poles.

36. This multipole beamline magnet of claim 1, further comprising a beam position sensor adjacent the central space.

37. The multipole beamline magnet of claim 1, wherein the stationary ferromagnetic poles are disposed equiangularly.

38. The multipole beamline magnet of claim 1, wherein the stationary ferromagnetic poles and the permanent magnets are provided in equal numbers.

39. The multipole beamline magnet of claim 1, wherein the stationary ferromagnetic poles are provided in an even number.

40. A method of selectively adjusting a magnetic field in a multipole beamline magnet, comprising:

providing a plurality of stationary ferromagnetic poles;

providing a plurality of permanent magnets disposed between the plurality of stationary ferromagnetic poles, each of the permanent magnets supplying magnetomotive force to two adjacent stationary ferromagnetic poles, thereby causing the stationary ferromagnetic poles to produce a magnetic field in a central space defined by the stationary ferromagnetic poles, wherein a mechanical axis extends through the central space perpendicularly to the plane defined by the poles and the magnets; and linearly moving the one or more permanent magnets perpendicularly to the mechanical axis.

41. The method of claim 40, wherein the step of moving the magnets comprises moving the permanent magnets to linearly increase or decrease the strength of the magnetic field in the central space.

42. The method of claim 40, wherein the step of moving the magnets comprises moving the permanent magnets to increase or decrease the strength of the magnetic field in the central space without changing the magnetic field's distribution.

43. The method of claim 40, wherein the step of moving the magnets comprises collectively moving all the permanent magnets in a radially inward or outward direction so as to increase or decrease the strength of the magnetic field in the central space, respectively.

44. The method of claim 40, wherein the step of moving the magnets comprises moving the magnets to linearly shift a magnetic centerline.

45. The method of claim 40, wherein the step of moving the magnets comprises moving the magnets to shift a magnetic centerline without changing the magnetic field strength.

46. The method of claim 40, wherein a pair of opposing permanent magnets are 180° apart, and the step of moving the magnets comprises moving the pair of opposing magnets in one direction so as to shift a magnetic centerline in the same direction.

47. The method of claim 40, further comprising providing a tuning shim to be magnetically coupled to the one or more permanent magnets to divert magnetic flux away from the central space.

48. The method of claim 40, further comprising providing a temperature compensating material to be magnetically coupled to the one or more permanent magnets in a parallel flux shunt configuration.

49. The method of claim 48, wherein the temperature compensating material is selectively attached to the one or more permanent magnets so that a field strength near the central space remains substantially constant regardless of changes in an ambient temperature.

50. The method of claim 48, wherein the temperature compensating material is selectively attached to the one or more permanent magnets so that a magnetic centerline remains at a fixed position regardless of changes in an ambient temperature.

51. The method of claim 40, further comprising:

providing a plurality of electromagnetic corrector coils;

selectively wiring the plurality of electromagnetic corrector coils; and selectively passing an electric current thorough the wired coils so as to supply predefined magnetomotive force to the stationary ferromagnetic poles.

52. The method of claim 40, further comprising the step of determining the strength of the magnetic field produced in the central space.

53. The method of claim 52, wherein the step of linearly moving the one or more permanent magnets comprises moving the one or more magnets based on the determined strength of the magnetic field.

54. The multipole beamline magnet of claim 1, comprising four ferromagnetic poles.

55. The multipole beamline magnet of claim 1, comprising six ferromagnetic poles.

* * * * *